US006241493B1

(12) United States Patent
Turner

(10) Patent No.: US 6,241,493 B1
(45) Date of Patent: Jun. 5, 2001

(54) SPHERICAL FLUID MACHINE WITH CONTROL MECHANISM

(75) Inventor: William Frank Turner, Burnet, TX (US)

(73) Assignee: Spherical Machines, Inc., Abilene, TX (US)

( * ) Notice: Subject to any disclaimer, the term of this patent is extended or adjusted under 35 U.S.C. 154(b) by 0 days.

(21) Appl. No.: 09/376,032

(22) Filed: Aug. 17, 1999

(51) Int. Cl.[7] ..... F01C 3/06; F01C 21/16

(52) U.S. Cl. ..... 418/1; 418/16; 418/68; 418/101

(58) Field of Search ..... 418/16, 22, 1, 418/68, 101

(56) References Cited

U.S. PATENT DOCUMENTS

| | | | | |
|---|---|---|---|---|
| 168,034 | | 9/1875 | Lyon . | |
| 826,985 | | 7/1906 | Appel . | |
| 1,678,050 | * | 7/1928 | Kearney | 418/68 |
| 1,946,343 | | 2/1934 | Wicha . | |
| 1,967,167 | | 7/1934 | Weis . | |
| 2,049,775 | * | 8/1936 | Holmes | 418/16 |
| 2,482,325 | | 9/1949 | Davis . | |
| 2,708,413 | * | 5/1955 | Loewen | 418/16 |
| 2,965,288 | | 12/1960 | Butler . | |
| 2,988,065 | | 6/1961 | Wankel et al. . | |
| 3,075,506 | * | 1/1963 | Berry | 418/68 |
| 3,139,871 | | 7/1964 | Larpent . | |
| 3,176,667 | | 4/1965 | Hammer . | |
| 3,277,792 | | 10/1966 | Stenerson . | |
| 3,492,974 | * | 2/1970 | Kreimeyer | 418/68 |
| 3,509,718 | | 5/1970 | Fezer et al. . | |
| 3,549,286 | | 12/1970 | Moriarty . | |
| 4,228,656 | | 10/1980 | MacGlashan | 60/518 |
| 4,441,869 | | 4/1984 | Larsen et al. | 418/51 |
| 4,938,025 | | 7/1990 | Larsen | 418/53 |
| 5,147,193 | | 9/1992 | Larsen | 418/68 |
| 5,199,864 | | 4/1993 | Stecklein | 418/68 |

FOREIGN PATENT DOCUMENTS

| | | | | |
|---|---|---|---|---|
| 808915 | * | 7/1951 | (DE) | 418/68 |
| 4020134 | * | 1/1992 | (DE) | 418/68 |
| 693047 | * | 10/1979 | (SU) | 418/68 |

* cited by examiner

*Primary Examiner*—John J. Vrablik
(74) *Attorney, Agent, or Firm*—Carr & Storm, L.L.P.

(57) ABSTRACT

A rotary fluid machine, such as a pump or motor, is provided with a fluid flow control mechanism that allows the flow of fluid to be easily and precisely controlled. The device has a housing with a spherical interior in which primary and secondary vanes rotate, with the secondary vane reciprocating between open and closed positions. The primary and secondary vanes define fluid chambers within the housing that communicate with inlet and outlet ports of the device. An adjustable fixed shaft, about which the secondary vane rotates, allows the degree of communication to be varied between the inlet and outlet ports and the chambers formed by the primary and secondary vanes. In this way, the flow rate or fluid capacity of the device, and even the direction of fluid flow, can be changed.

122 Claims, 12 Drawing Sheets

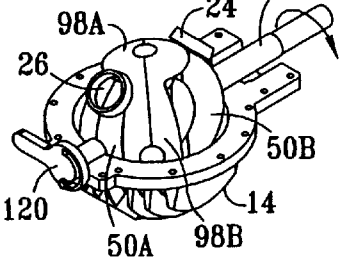
FIG. 10A
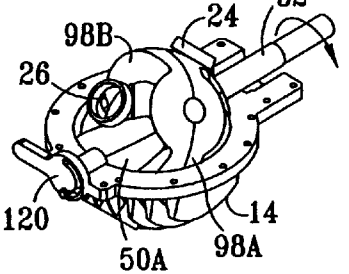
FIG. 10B
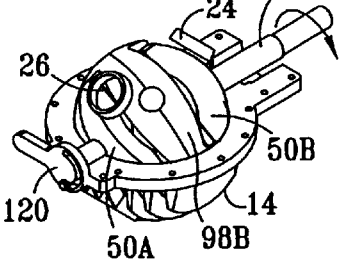
FIG. 10C
FIG. 10D
FIG. 10E
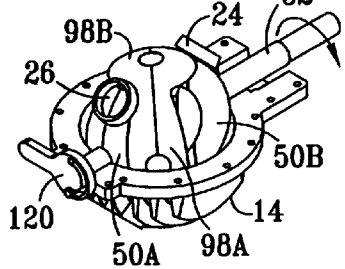
FIG. 12A
FIG. 12B
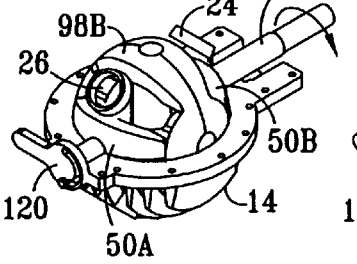
FIG. 12C
FIG. 12D
FIG. 12E
FIG. 14A
FIG. 14B
FIG. 14C
FIG. 14D
FIG. 14E

SPHERICAL FLUID MACHINE WITH CONTROL MECHANISM

TECHNICAL FIELD

The invention relates generally to fluid flow machines or devices such as motors, pumps or compressors and, more particularly, to the construction and control of such machines utilizing rotary mounted vanes.

BACKGROUND

Rotary motors, pumps and compressors have been known for many years. Generally these devices consist of a housing or casing within which one or more vanes rotate. This is in contrast to those devices which utilize a reciprocating, linearly moving piston. In the case of rotary pumps or compressors, the vanes are rotated by a shaft to pressurize or cause the fluid to flow through the device. In the case of a rotary motor, the opposite occurs. Fluid is introduced into the device under pressure to displace the vanes, which in turn rotates and powers a drive shaft to which the vanes are coupled.

For rotary fluid pumps, the flow of fluid is typically controlled by the rate at which the rotary vanes are rotated. By increasing the speed, more fluid is pumped through the device, while decreasing the speed decreases the amount of fluid pumped. Further, reversing the flow through the device, if possible at all, requires the vanes to be rotated in the opposite direction or requires that the inlet and outlet ports be reconfigured or reversed.

U.S. Pat. No. 5,199,864 discloses a rotary fluid pump that employs vanes rotating within a spherical housing. These devices are highly efficient, and are capable of displacing large quantities of fluid. The flow capacity of these devices, however, is also usually controlled by varying the speed at which the vanes are rotated within the housing. Because this typically requires varying the speed of the motor that rotates the rotary shaft, the flow rate is often difficult to control with any degree of precision. Further, the direction of flow cannot be reversed without modifying the device or reversing the direction of rotation of the drive shaft that drives the vanes.

Other mechanical limitations apply to these prior art devices, such as inadequate removal of heat from the devices, the construction of the vanes to provide improved performance, and methods of securing together the components of the spherical race assembly about which the vanes rotate.

What is therefore needed is a fluid machine or device, such as a rotary motor, pump or compressor, in which the fluid flow through the device can be controlled in an effective, simple and precise manner, and which allows the rotary or drive shaft of the device to be rotated at a generally constant rate or direction of rotation while the direction or rate of fluid flow is varied, and which also addresses the mechanical limitations of the prior art devices.

SUMMARY

These and other needs are addressed by the present invention, which provides a method and apparatus for controlling the flow of fluid through a rotary pump, compressor, motor, and similar devices. In the present invention, at least one primary vane rotates within a housing, causing at least one secondary vane to pivotally oscillate between alternating open and closed positions, respectively further from and closer to the primary vane. Fluid is displaced through a port in the housing as the secondary vane approaches the closed position, while fluid enters the housing as the secondary vane approaches the open position. The quantity or direction of flow of fluid through the port is adjusted by varying the point during rotation of the primary vane or timing at which the closed and open positions are reached, relative to the port.

In another aspect of the invention a method and apparatus for controlling or regulating fluid flow through a fluid machine, such as a motor, fluid pump or compressor, is provided. The device is provided with a housing having at least two fluid ports in communication with the interior of the housing. At least one of the ports is in communication with a fluid source. A primary vane is disposed within the interior of the housing. A rotary shaft having a primary axis of rotation is coupled to and rotates the primary vane about the primary axis. A secondary vane is mounted for pivotal movement between open and closed positions with respect to the primary vane, about a pivotal axis passing through the primary vane, as the primary vane rotates. The primary and secondary vanes divide the interior of the housing into chambers, with the volume of the chambers varying as the secondary vane is moved between the open and closed positions. Pivoting of the secondary vane between open and closed positions is accomplished by a guide that directs diametrically opposed points on the secondary vane to rotate about a secondary vane rotational axis intersecting, but angularly offset from, the primary pivotal axis of the secondary vane. The secondary vane pivotal and rotational axes define a control plane.

By adjusting the secondary vane guide and therefore also adjusting the control plane, both the rate of flow and direction of flow of fluid through the ports of the housing can be altered to thereby regulate fluid flow through the machine.

In another aspect of the invention, the housing includes cooling fins for enhancing heat transfer with the surrounding environment.

In yet another aspect of the invention, at least a substantial portion of one or more of the vanes is hollow to reduce material cost, weight and enhance performance of the device.

In still another aspect of the invention, the actuator includes a timing plate or lever that is adjusted relative to the position of one or more ports to control the flow rate or direction of fluid.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

For a more complete understanding of the present invention, and the advantages thereof, reference is now made to the following descriptions taken in conjunction with the accompanying drawings, in which:

FIGS. 10A–10E are sequenced perspective views of the pump of FIGS. 9A–9D with the control lever in the 0° position, as the rotary shaft of the pump is rotated 180° during the pump's operation;

FIGS. 12A–12E are sequenced perspective views of the pump of FIGS. 11A–11D, with the control lever in a 180° position, as the rotary shaft of the pump is rotated 180° during the pump's operation;

FIGS. 14A–14E are sequenced perspective views of the pump of FIGS. 13A–13D, with the control lever in the 90° or neutral position, as the rotary shaft of the pump is rotated 180° during the pump's operation;

DETAILED DESCRIPTION

Figure 1:
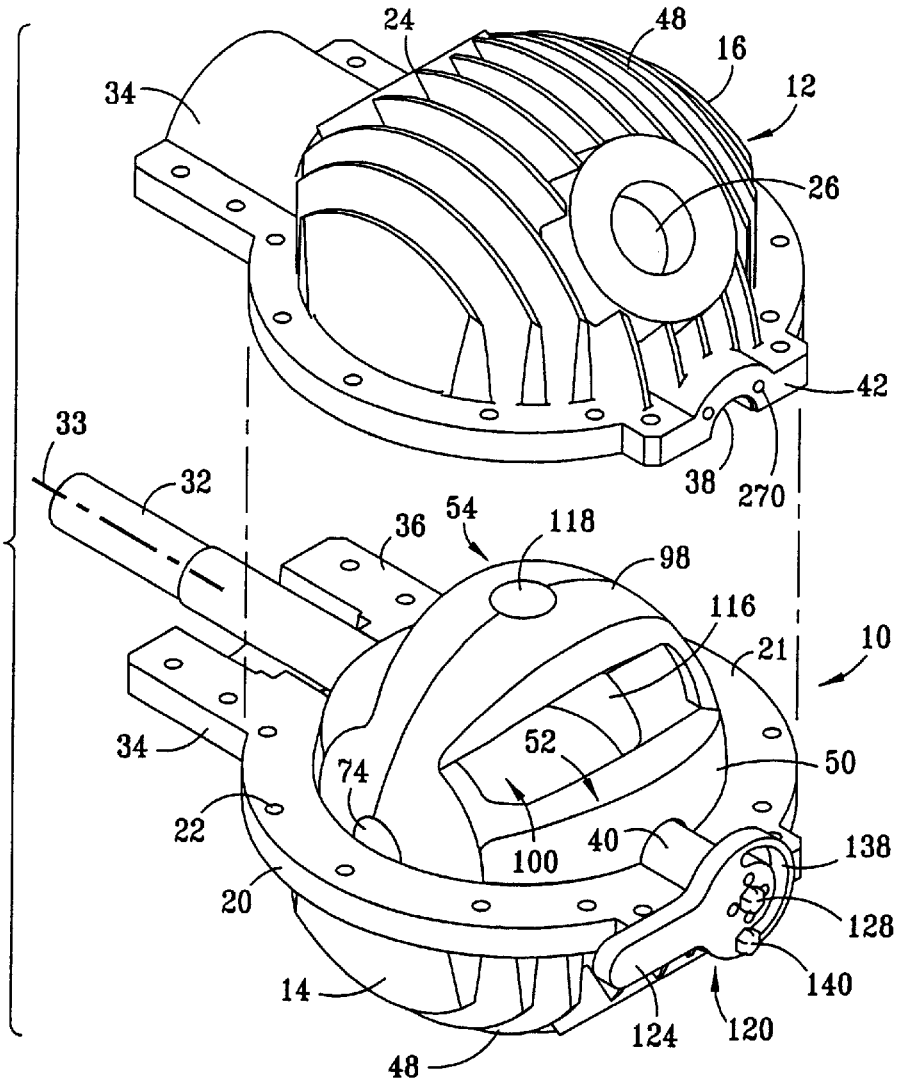
FIG. 1 is front perspective view of a fluid pump, shown with the upper half of a housing of the pump exploded away to reveal internal components of the device, and constructed in accordance with the invention.

Referring to FIG. 1 of the drawings, the reference numeral 10 generally designates a fluid pump or compressor embodying features of the present invention. The pump 10 is generally similar in construction to the device described in U.S. Pat. No. 5,199,864, which is herein incorporated by reference. It should be noted that although the device 10 has been more specifically described with respect to its function and use as a fluid pump or compressor, it could also function as motor, as would be readily appreciated by those skilled in the art.

The pump 10 includes a metal housing 12, such as steel or aluminum, which is formed into two halves 14, 16. Although the housing 12 and other components of the pump 10 are generally described and shown herein as being constructed of metal, many other materials, such as plastic or polymeric materials, could be used as well, depending upon the application of the device 10 and would be appreciated by those skilled in the art. Accordingly, the invention should not be limited to the particular types of materials that are used in its construction.

Figure 2:
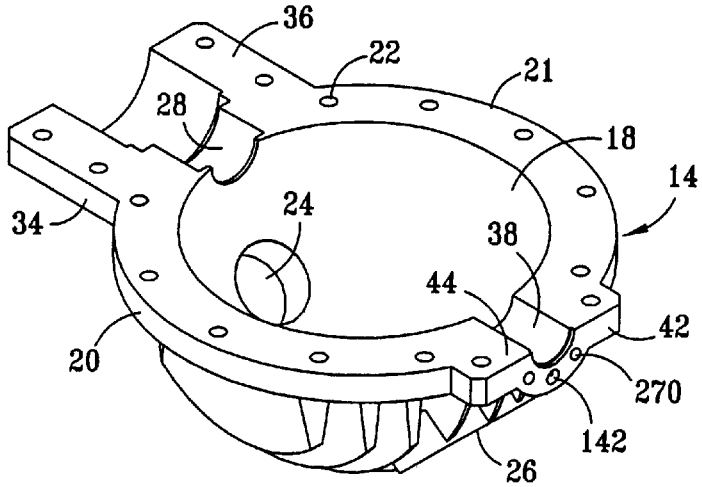
FIG. 2 is a perspective view of the lower half of the housing of the pump of FIG. 1 with the internal components removed.

Each half 14, 16 of the housing 12 is generally configured the same as the other and has a hemispherical interior cavity 18 (FIG. 2), which forms a spherical interior of the housing 12 when the two halves 14, 16 are joined together. Each housing half or piece 14, 16 is provided with a circular flange 20 having a flat facing surface 21 which extends around the perimeter of the cavity 18 and which abuts against and engages the corresponding flange 20 of the other housing piece 14, 16. The flange face 21 lies in a plane that generally divides the spherical housing interior 18 into two equal hemispherical halves when the housing halves 14, 16 are joined together.

A fluid tight seal is formed between the housing halves 14, 16 when the halves 14, 16 are joined together. A gasket or seal (not shown) may be interposed between the flange faces 21 to accomplish this. The flange 20 may be provided with holes 22 to accommodate bolts or fasteners (not shown) for joining the housing halves 14, 16 together. Alternatively, the halves 14, 16 may be welded, glued or otherwise joined together in a conventional manner as would be readily known to those skilled in the art. Preferably, however, the housing halves 14, 16 are secured together in a nonpermanent manner to allow access to the housing interior if necessary.

Formed in each housing piece 14, 16 are rear and front fluid ports 24, 26 that communicate between the exterior of the housing and the housing interior 18. In the preferred embodiment, the fluid ports 24, 26 are circumferentially spaced apart approximately 90° from the next adjacent port, with the approximate center of each fluid port being contained in a plane oriented perpendicular to the flange faces 21 and that bisects the interior of the housing 12 when the housing halves 14, 16 are joined together. Preferably, the ports 24, 26 are positioned about 45° from the flange faces 21 on each housing half 14, 16.

Formed at the rearward end of each housing half 14, 16 adjacent to the rearward port 24 is a recessed area 28 formed in the circular flange 20 for receiving a main input shaft 32 (FIG. 1), which extends for a distance into the housing interior 18. The primary axis or axis of rotation 33 of the input shaft 32 lies generally in the same plane as the flange faces 21. An input shaft collar 34 extends outwardly from the housing halves 14, 16 and is provided with a similarly flanged surface 36 for facilitating joining the housing halves together.

Located at the forward end of the housing 12 opposite the collar 34 in each housing half 14,16 is a recessed area 38 formed in the circular flange 20 to form a shaftway for receiving a fixed shaft 40 (FIG. 1). A neck piece 42 extends outwardly from the circular flange 20 and is also provided with a flanged surface 44 to facilitate joining of the housing halves together.

In the particular embodiment shown, the exterior of the housing 12 is provided with a plurality of parallel spaced apart fins or ribs 48 which provide structural rigidity to the housing while reducing the weight of the device. The fins or ribs 48 also provide an increased surface area of the housing to facilitate heat transfer.

Figure 3:
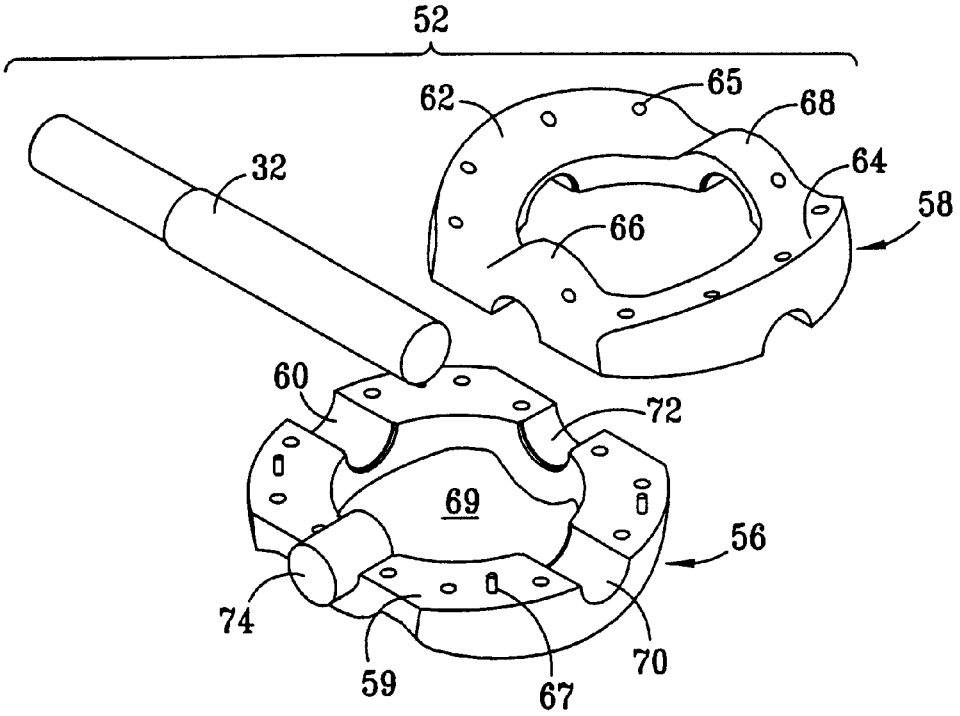
FIG. 3 is a perspective view of a rotary shaft and primary vane assembly of the pump of FIG. 1, shown with the primary vane assembly exploded into two halves.

The housing 12 houses primary and secondary vane assemblies 52, 54, respectively. Referring to FIG. 3, the primary vane assembly, designated generally at 52, is formed into two metal halves 56, 58. The primary vane halves 56, 58 are generally configured the same, each having a generally flat inner surface 59 that abuts against the inner surface of the other half. The primary vane halves 56, 58 each have opposite vane members 62, 64, that are joined together at opposite ends by integral hinge portions 66, 68 to define a central circular opening 69. When the primary vane halves 56, 58 are joined together, the vane members 62; and 64 form single opposing vanes 50. Bolt holes 65 for receiving sunken bolts or screws (not shown) are provided for this purpose. The vane halves 56, 58 may be joined together, however, by many other fastening means, and may be glued, welded or otherwise secured together in any conventional manner known by those skilled in the art. Alignment dowels 67 received within dowel holes formed in the faces 59 may also be provided to ensure that the vane halves 56, 58 are properly mated and fastened together.

The vane members 62 are each provided with an input shaft recess 60 formed in the flat surface 59 for receiving and coupling to the input shaft 32 when the vane halves 56, 58 are joined together. The primary vane assembly 52 is rigidly coupled to the input shaft 32 so that rotation of the input shaft 32 is imparted to the primary vane assembly 52 to rotate the opposing vanes 50 within the housing interior 18.

Similarly, the vane members 64 are provided with a fixed shaft recess 70 formed in the flat surface 59 for receiving the fixed shaft 40. The fixed shaft recess 70 is configured to allow the primary vane assembly 52 to freely rotate about the fixed shaft 40. The outer ends of the vane members 62, 64 have a generally convex spherical lune surface configuration corresponding to the spherical interior 18 of the housing 12.

The hinge portions 66, 68 are each provided with a stub shaft recess 72. A stub shaft 74 is shown provided with the hinge portion 66 of the vane half 56. This stub shaft 74 may be integrally formed with one of the vane halves 56, 58 or may be a separate member that is fixed in place. As is shown, the stub shaft 74 projects a distance outward beyond the hinge portion 66. The hinge portions 66, 68 are each squared or flat along the outer side edges.

Figure 4:
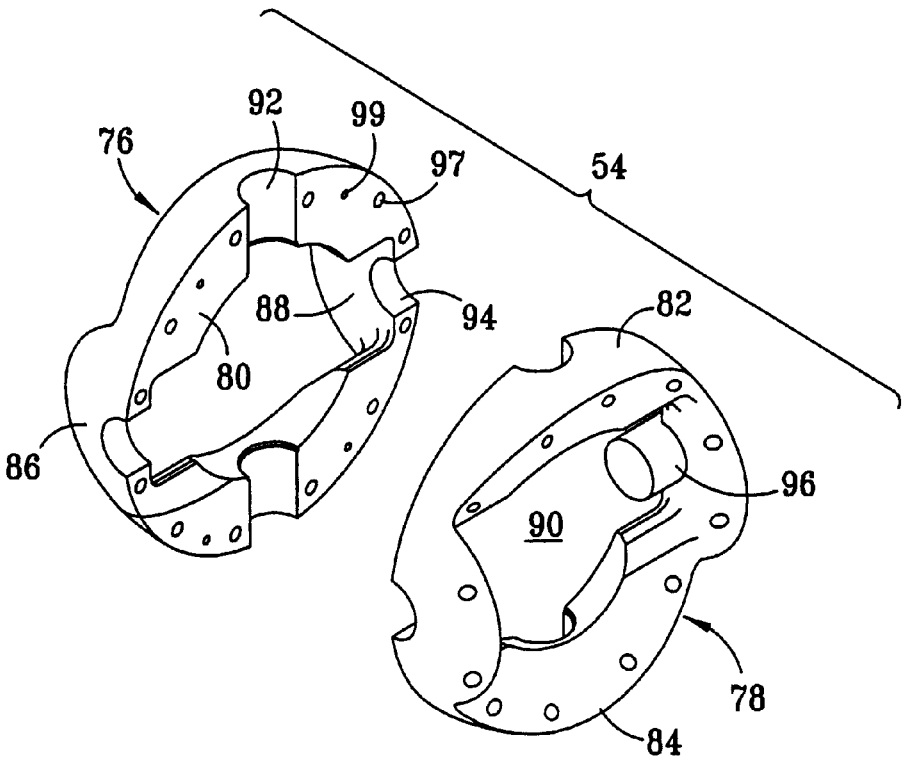
FIG. 4 is a perspective view of a secondary vane assembly of the pump of FIG. 1, shown with the secondary vane assembly exploded into two halves.

Referring to FIG. 4, the secondary vane assembly 54 is also shown being formed in two halves 76, 78, each half 76, 78 being generally similar in construction. The secondary vane halves 76, 78 are formed of metal and are generally configured the same, each having an inner surface 80, which is generally flat and which abuts against the inner surface of the other vane half. The secondary vane halves 76, 78 each have opposite vane members 82, 84, that are joined together at opposite ends by integral hinge portions 86, 88 to define a central circular opening 90. When the secondary vane halves 76, 78 are joined together, the vane members 82; and 84 form single opposing vanes 98. The vane halves 76, 78 may be joined together by bolts, screws or other fasteners, or may be glued or otherwise secured together in any conventional manner well known by those skilled in the art. Bolt holes 97 are provided for this purpose. Additionally, dowel holes 99 for receiving alignment dowels, such as the alignment dowels 67 of FIG. 3, may also be provided.

The vane members 82, 84 are each provided with pivot post recesses 92 formed in the inner surfaces 80 of each vane half 76,78. The outermost ends of the vane members 82, 84 also have a generally convex spherical lune surface configuration corresponding to the spherical interior 18 of the housing 12.

The hinge portions 86, 88 are each provided with a stub shaft recess 94. A second stub shaft 96 is shown provided with the hinge portion 88 of the vane half 78. This stub shaft 96 may be integrally formed with one of the vane halves 76, 78 or may be a separate member that is fixed in place. As is shown, the stub shaft 96 projects a distance inward from the hinge portion 88. Both the hinge portions 86, 88 are squared or flat along the inner side edge to correspond to the flat exterior side edges of the hinge portions 66, 68 of the primary vane halves 56, 58. The exterior of the hinge portions 86, 88 are in the form of a convex spherical segment or sector that is contoured smoothly with the curved surface of the outer ends of the vane members 82, 84, and corresponds in shape to the spherical interior 18 of the housing 12.

When the primary and secondary vanes 52, 54 are coupled together (FIG. 1) and mounted to the main input shaft 32, the stub shafts 74, 96 are generally concentric. The stub shaft 74 of the primary vane assembly 52 is received within the recesses 94 of the hinge portion 86 of the secondary vane assembly 54 to allow relative rotation of the secondary vane assembly 54 about the stub shaft 74. Likewise, the stub shaft 96 of the secondary vane assembly 54 is received within the recesses 72 of the hinge portion 68 of the primary vane assembly 52 and allows relative rotation of the primary vane assembly 52 about the stub shaft 96. In this way, the primary and secondary vanes assemblies 52, 54 remain interlocked together while the secondary vane assembly 54 is allowed to pivot relative to the primary vane assembly 52 about an axis that is perpendicular to the primary axis 33 of the input shaft 32.

Figure 5:
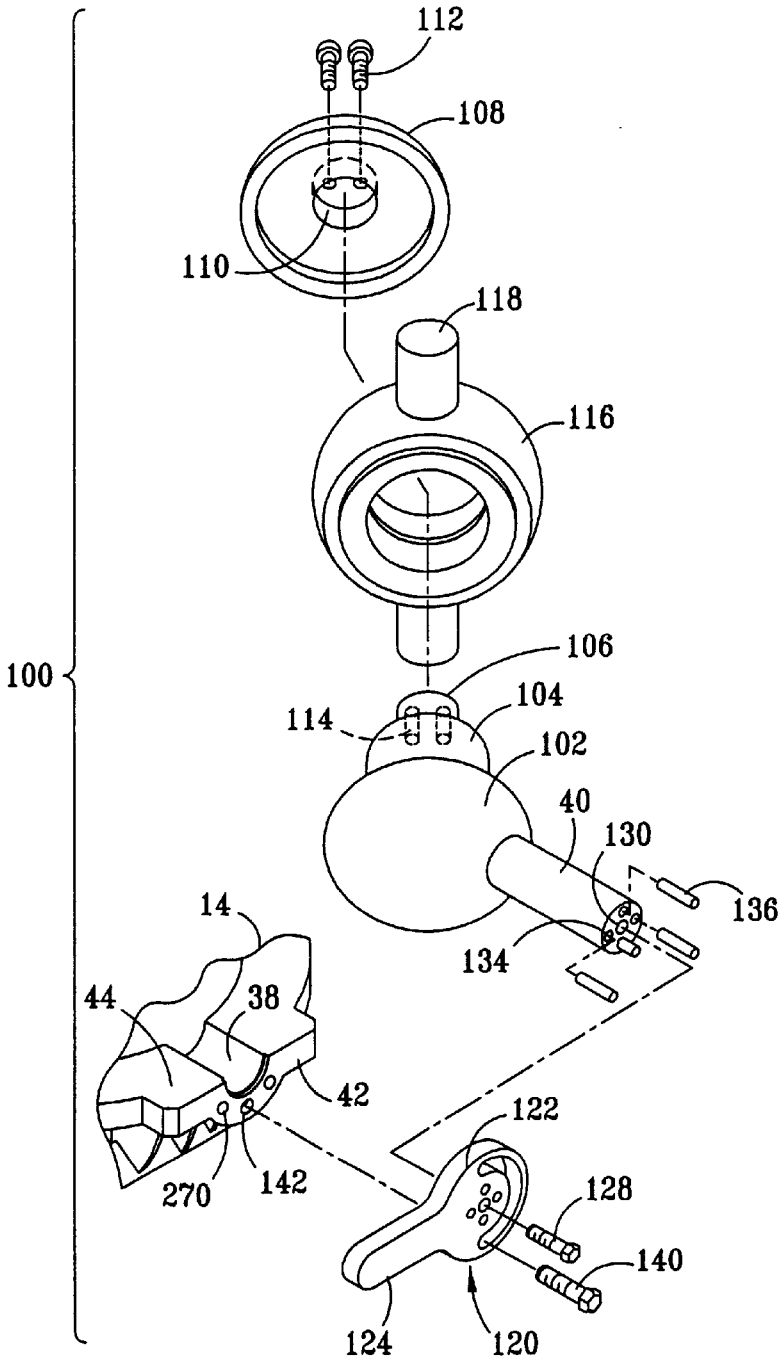
FIG. 5 is an exploded perspective view of a fixed shaft assembly of the pump of FIG. 1, constructed in accordance with the invention.

FIG. 5 shows an exploded view of a fixed shaft or race assembly 100. The fixed shaft assembly 100 is comprised of the cylindrical shaft 40, which is received in the recesses 38 of the housing halves 14, 16, as discussed previously. The cylindrical shaft 40 is coaxial with the primary axis 33 of the input shaft 32 when mounted to the housing 12. At the inner end of the shaft 40 is a spherical shaft portion 102 in the form of a sphere section. Projecting from the inner side of the spherical shaft portion 102 is a cylindrical carrier ring shaft 104. The longitudinal axis of the carrier ring shaft 104 is oriented at an oblique angle with respect to the axis of shaft 40. This angle may vary, but is preferably between about 30° to 60°, with 45° being the preferred angle. A boss 106 projects from the end of the shaft 104 to facilitate mounting of an end cap 108, which is in the form of a spherical section. The end cap 108 is provided with a recess 110 for receiving the boss 106 of shaft 104. In the embodiment shown, a pair of threaded fasteners 112, such as screws or bolts, which are received within eccentrically disposed threaded bolt holes 114 formed in the boss 106, are used to secure and fix the end cap 108 to the shaft 104. Two or more fasteners may be used. Because the fasteners are eccentrically located with respect to the axis of the shaft 40, they prevent relative rotation of the end cap 108 with respect to the shaft 40.

The end cap 108 is used to secure a central carrier ring 116, which is rotatably mounted on the carrier ring shaft 104. The carrier ring 116 is configured with an outer surface in the form of a spherical segment so that when the carrier ring 116 is mounted on the shaft 104 and the end cap 108 is secured in place, the combination of the spherical portion 102, carrier ring 116 and end cap 108 generally form a complete sphere that is joined to the end of the shaft 40. The diameter of this sphere generally corresponds to the diameter of the central openings 69, 90 of the primary and secondary vane assemblies 52, 54, respectively, to allow the vane assemblies 52, 54 to rotate about this spherical portion of the fixed shaft assembly 100, while being in close engagement thereto. The carrier ring 116 is centered between the spherical portion 102 and the end cap 108.

The carrier ring 116 is provided with oppositely projecting pivot posts 118 which project radially outward from the outer surface of the carrier ring 116. The posts 118 are concentrically oriented along an axis that is perpendicular to the axis of rotation of the carrier ring 116. The posts 118 are received within the pivot post recesses 92 of the secondary vane halves 76, 78 when the vane assembly 50 is mounted over the spherical portion of the fixed shaft assembly 100 formed by the spherical portion 102, carrier ring 104 and end cap 108.

Figure 6:
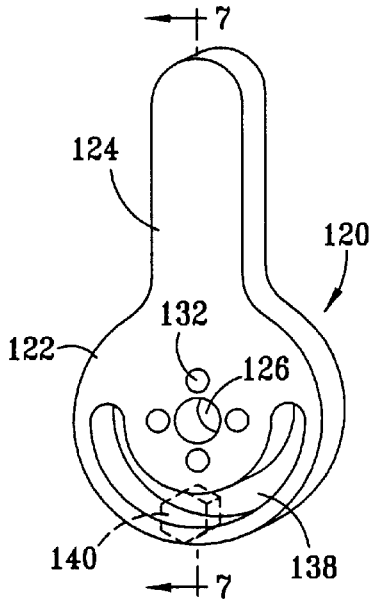
FIG. 6 is a perspective view of a flow capacity control lever for rotating the fixed shaft of FIG. 5, and constructed in accordance with the invention.
Figure 7:
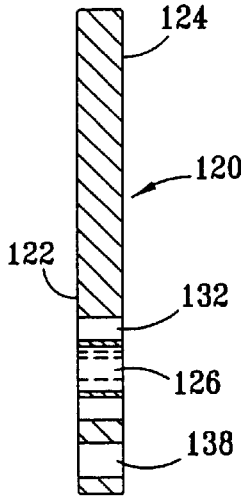
FIG. 7 is a cross-sectional view of the lever of FIG. 6 taken along the lines 7—7.

Coupled to the shaft 40 opposite the spherical portion 102 is a flow capacity control lever 120 for manually rotating the shaft 40 and spherical portion 102. The control lever 120, shown in more detail in FIGS. 6 and 7, has a generally circular-shaped body portion 122. A lever arm 124 extends from the body portion 122. Formed generally in the center of the body portion 122 is a bolt hole 126 for receiving a bolt 128 for fastening the lever 120 to the shaft 40 by means of a central, threaded bolt hole 130 formed in the outer end of the shaft 40. Spaced around the bolt hole 126 are dowel holes 132 which correspond to dowel holes 134 formed in the shaft. Dowels 136 are received within the dowel holes 132, 134 to prevent relative rotation of the control lever 120 with respect to the shaft 40. Although one particular method of coupling the lever 120 to the shaft 40 is shown, it should be apparent to those skilled in the art that other means may be used as well.

An arcuate slot 138 which extends in an arc of about 180° is formed in the body portion 122 of the lever 120 for receiving a set screw or bolt 140. The arcuate slot 138 overlays a threaded bolt hole 142 formed in the housing neck piece 42 of the housing half 14, when the shaft assembly 100 is mounted to the housing 12. The set screw 140 is used to fix the position of the lever 120 to prevent rotation of the shaft 40 once it is in the desired position. By loosening the set screw 140, the lever 120 can be rotated to various positions to rotate the shaft assembly 100, with the set screw 140 sliding within the slot 138.

Figure 8A:
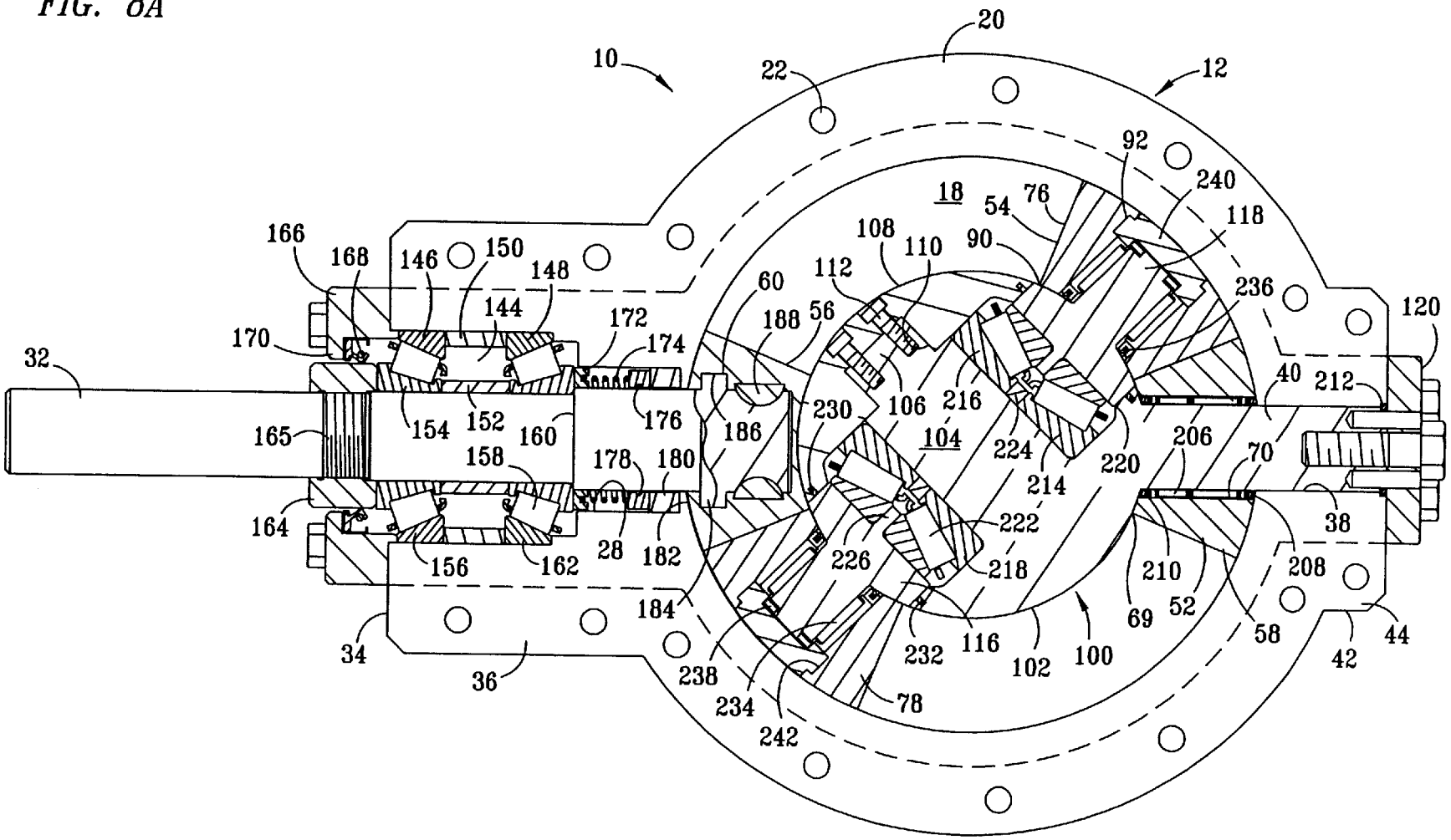
FIG. 8A is a detailed cross-sectional view of the pump of FIG. 1.

FIG. 8A is a longitudinal cross-sectional view of the assembled pump 10 shown in more mechanical detail. Although one particular embodiment is shown, it should be apparent to those skilled in that a variety of different configurations and components, such as bearings, seals, fasteners, etc., could be used to ensure the proper operation of the pump 10. The embodiment described is for ease of understanding the invention and should in no way be construed to limit the invention to the particular embodiment shown.

As can be seen, the input shaft 32 extends through the collar 34 at the rearward end of the housing 12. The collar 34 defines a cavity 144 that houses a pair of longitudinally spaced input shaft roller bearing assemblies 146, 148. Each of the roller bearing assemblies 146, 148 is comprised of an inner race 154 and an outer race 156, which houses a plurality of circumferentially spaced tapered roller bearings 158 positioned therebetween. Spacers 150, 152 maintain the roller bearing assemblies 146, 148 in longitudinally spaced apart relationship along the input shaft 32, with the inner race 154 of the roller bearing assembly 148 abutting against an outwardly projecting annular step 160 of the drive shaft 32, and the outer race 156 abutting against a inwardly projecting annular shoulder 162 of the collar 34.

A bearing nut 164 threaded onto a threaded portion 165 of the input shaft 32 abuts against the inner race 154 of bearing assembly 146 and preloads the inner races 154. Bolted to the end of the collar 34 is a bearing retainer ring 166. The bearing retainer ring 166 abuts against the outer race 156 of bearing assembly 146 and preloads the outer bearing races 156. The retainer ring 166 also serves to close off the cavity 144 of the housing collar 34. An annular oil seal 168 seated on the annular lip 170 of the retainer ring 166 bears against the exterior of the bearing nut 164 to prevent leakage of oil or lubricant from the bearing cavity 144.

Located within the recessed area 28 and surrounding the input shaft 32 is a washer 172 that abuts against the inner race 154 of the bearing assembly 148. A compressed coiled spring 174 abuts against the washer 172 and bears against a carbon sleeve 176. The sleeve 176 is provided with an O-ring seal 178 located within an inner annular groove of the sleeve 176. The sleeve 176 abuts against a fixed annular ceramic plate 180, which seats against an annular lip 182 projecting into the recessed area 28. The low coefficient of friction between the interfacing carbon sleeve 176 and ceramic plate 180 allows the sleeve 176 to rotate with the input shaft 32, while providing a fluid-tight seal to prevent fluid flow between the pump interior 18 and the collar cavity 144.

The input shaft 32 extends into the interior 18 of the housing 12 a short distance and is coupled to the primary vane assembly 52 within the recesses 60 formed in vane halves 56, 58. The end of the shaft 32 is provided with a annular collar 184 received in grooves 186 formed in the recesses 60 of the vane halves 56, 58 to prevent relative axial movement of the shaft 32 and vane assembly 52. Rotational movement of the vane assembly 52 and shaft 32 is prevented by key members 188 received in key slots of the vane assembly 52 and shaft 32, respectively.

Surrounding the fixed shaft portion 40 within the recess 70 of the primary vane assembly 52 are longitudinal roller bearings 206. Seals 208, 210 are provided at either end of the roller bearing assembly 206 to prevent fluid from escaping along the fixed shaft 40 through recesses 70. A static O-ring seal 212 surrounds the shaft 40 at the interface of the lever arm 120 with housing neck piece 42 to prevent fluid loss through shaftway 38.

Surrounding the carrier ring shaft 104 are roller bearing assemblies 214, 216. Each roller bearing assembly 214, 216 is comprised of an inner race 218 and an outer race 220 with a plurality of tapered roller bearings 222 therebetween. The inner races 218 of assemblies 214, 216 are spaced apart by means of a spacer 224. The inner face of the carrier ring 116 rests against the outer races 220. An annular web 226 projects radially inward from the inner annular face of the carrier ring 116 and serves as a spacer between the outer races 220 and prevents axial movement of the carrier ring 116 along the shaft 104.

Lip seals 230, 232 provided in inner faces of the end cap 108 and spherical portion 102, respectively, engage the side edges of the carrier ring 116 to prevent fluid from entering the annular space surrounding the carrier ring shaft 104 where the bearing assemblies 214, 216 are housed and which contains a suitable lubricant for lubricating the bearing assemblies 214, 216.

Axially oriented roller bearings 234 surround the pivot posts 118 to allow the secondary vanes 54 to rotate. Fluid seals 236 are provided at the base of posts 118. Radially oriented thrust bearings 238 located at the terminal ends of posts 118 and are held in place by thrust caps 240. The thrust caps 240 are held in place within annular grooves 242 formed in the pivot post recesses 92.

As can be seen, the outer ends of the primary vanes 52 and secondary vanes 54 are in close proximity or a near touching relationship to provide a clearance with the interior 18 of the housing 12. There is also a slight clearance between the spherical end portion of the fixed shaft assembly 100 and the central openings 69, 90 of the primary and secondary vanes 52, 54. These clearances should be as small as possible to allow free movement of the vanes 52, 54 within the interior 18, while minimizing slippage or fluid loss across the clearances.

Figure 8B:
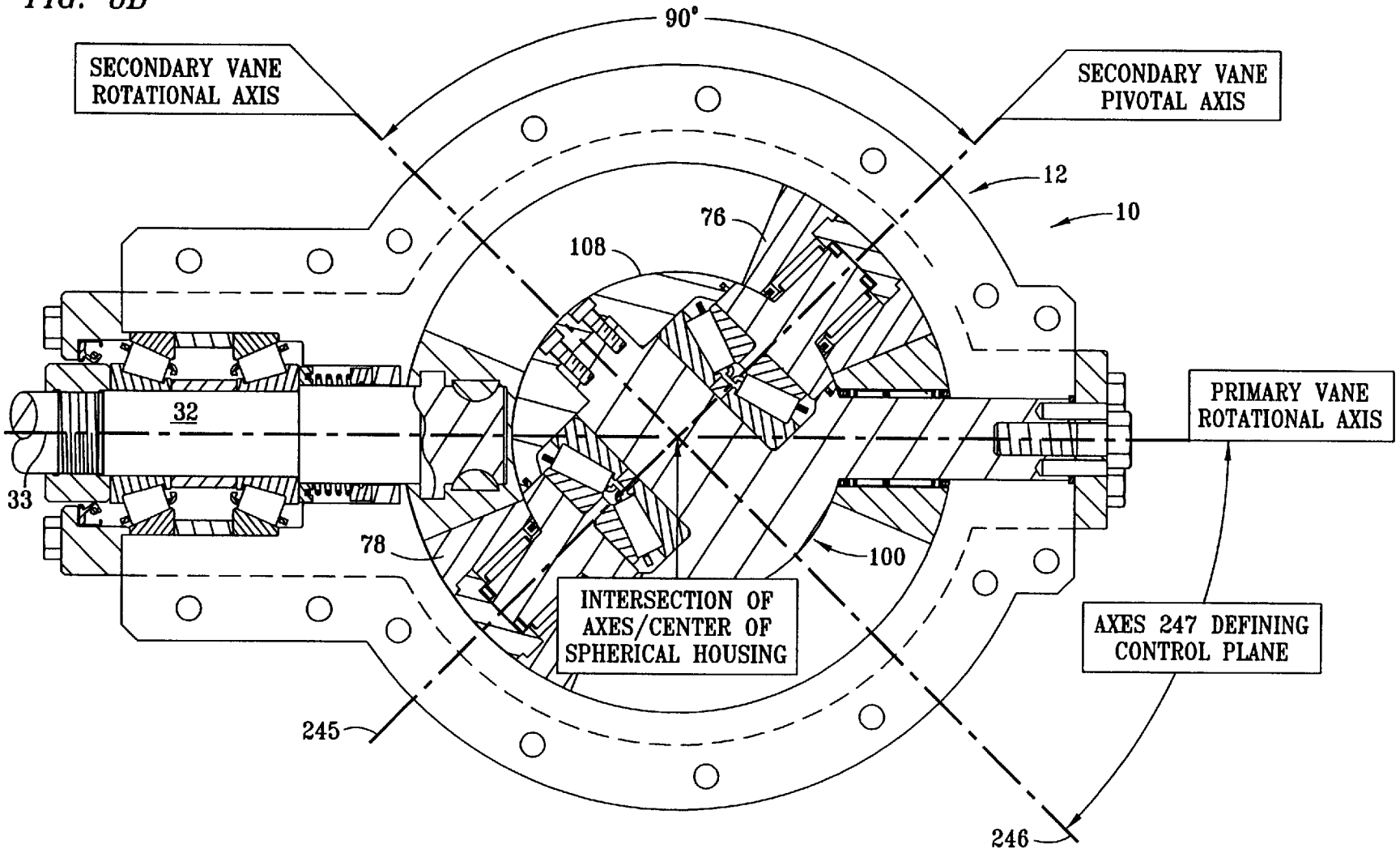
FIG. 8B is a cross-sectional view of the pump of FIG. 1, showing various rotational axes of the device.

FIG. 8B illustrates the relationship of the various rotational axes of the pump components. As shown, the secondary vane 54 rotates about a secondary vane rotational axis, which is the same as the carrier ring axis 246. The axis 246 intersects the primary vane axis 33 at an oblique angle and defines a control plane 247. The secondary vane 54 pivots around the pivot posts 118 about a secondary vane pivot axis 245 that remains perpendicular to the carrier ring axis 246.

Figure 8C:
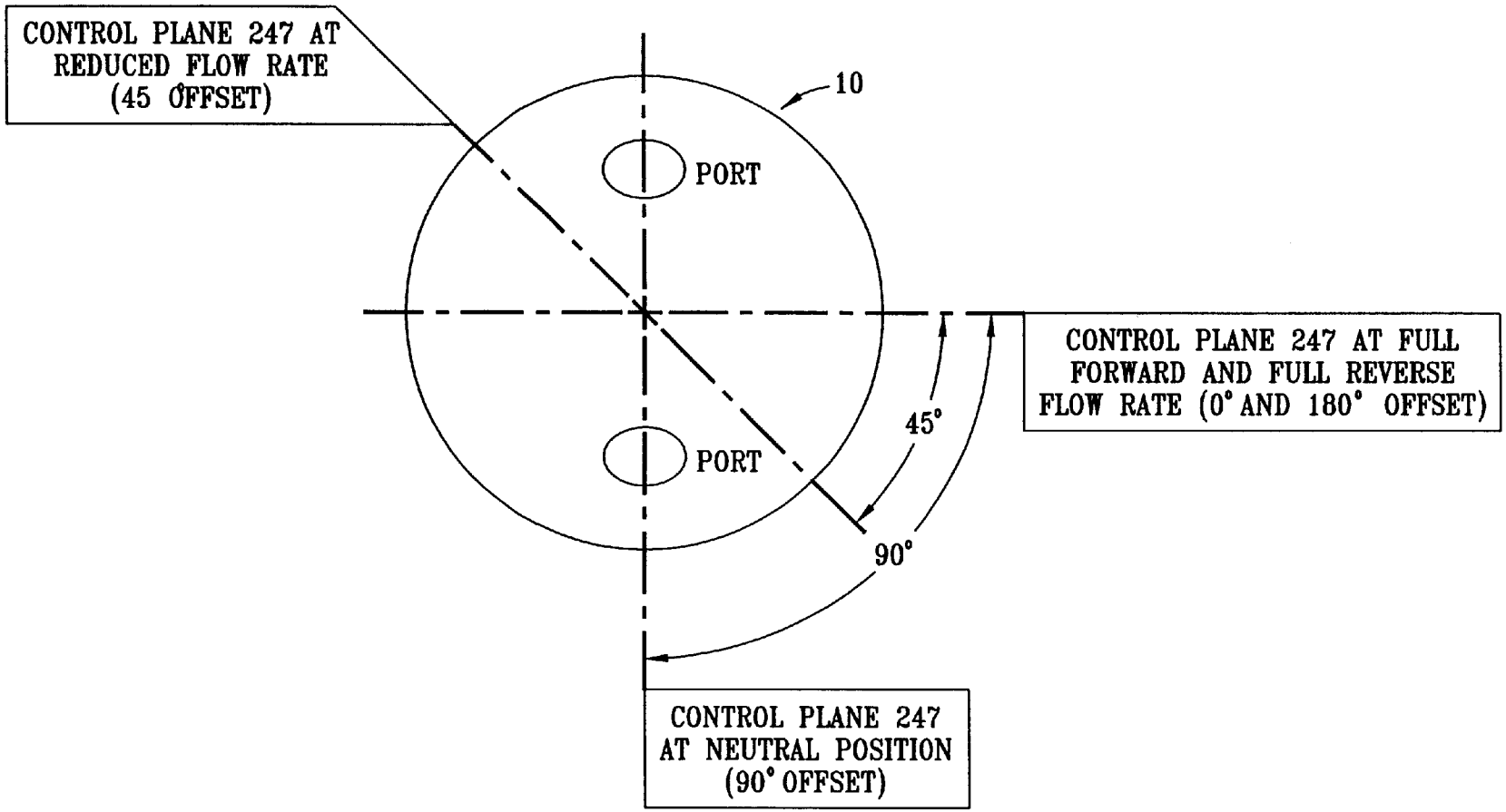
FIG. 8C is a schematical diagram of the pump housing showing the rotation of a control plane with respect to the pump housing.

FIG. 8C shows an end view of the pump 10 as viewed along the primary axis, and showing the various orientations of the timing or control plane 247 that may be achieved by rotating the fixed shaft assembly 100, as is described below.

Referring to FIGS. 9–14, the pump 10 is shown with the upper housing 16 removed to reveal the internal components of the pump 10. The ports 24, 26 of the upper housing 16, however, are shown to indicate their relative position if the upper housing 16 were present. Further, although the input shaft 32 may be rotated in either a clockwise or counterclockwise direction, for purposes of the following description the operation of the pump 10 is described wherein the input shaft 32 is rotated in a clockwise direction, as indicated by the arrow 244.

Referring to FIGS. 9A–9D, the pump 10 is shown with the lever 120 fully rotated to an initial 0° position. With the lever 120 in this position, the fixed shaft assembly 100 is oriented so that the carrier ring or secondary axis 246 is oriented at a 45° angle to the right of the primary axis 33, as viewed in FIG. 9C, so that the control plane 247 (FIGS. 8B and 8C) lies in a substantially horizontal plane that is generally the same or parallel to the plane of the flanges 20 which bisect the housing 12.

FIGS. 9A–9D show the primary and secondary vanes 50, 98 with the secondary vane 98 at a central intermediate position of its stroke. The forward port 26 of the upper housing 16 and the rearward port 24 of the lower housing 14 serve as discharge ports, while the rearward port 24 of the upper housing 16 and the forward port 26 of the lower housing 14 serve as intake ports. The primary and secondary vanes 50, 98 divide the spherical interior 18 of the housing into four chambers, as defined by the spaces between the primary and secondary vanes 50, 98 designated at 248, 250. Although not visible, corresponding spaces or chambers would be present in the lower housing half 14.

Figure 9C:
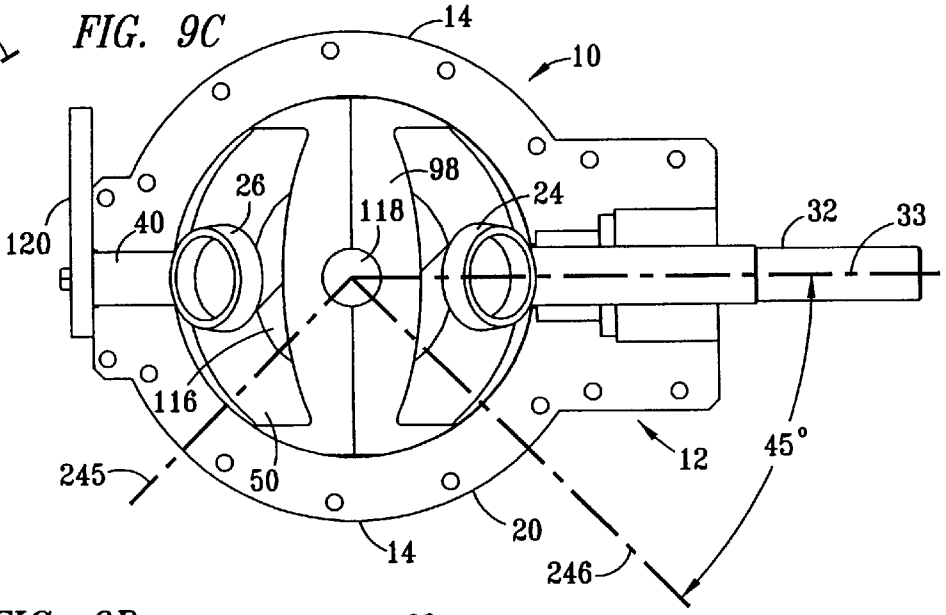
FIG. 9C is a top plan view of the pump of FIG. 9A.
Figure 9D:
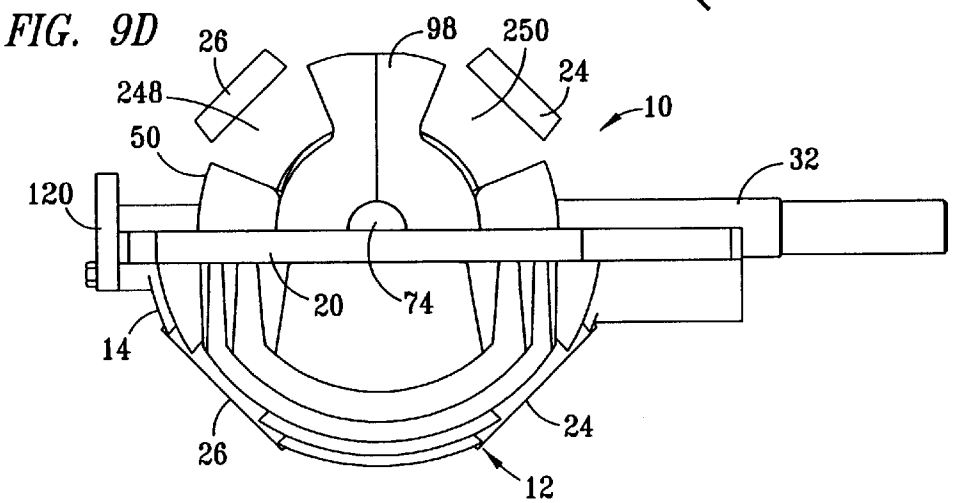
FIG. 9D is a side elevational view of the pump of FIG. 9A.
Figure 9A:
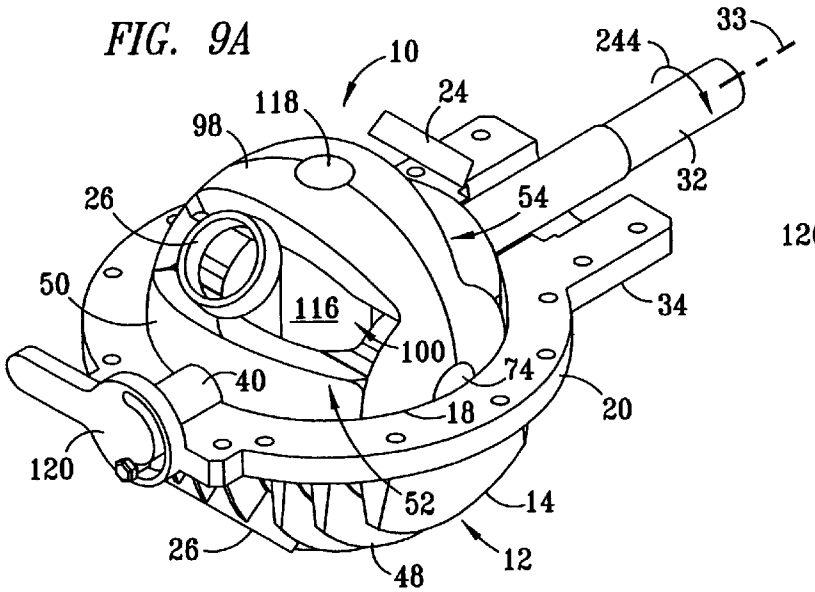
FIG. 9A is a perspective view of the pump of FIG. 1 shown with the upper half of the housing removed and the control lever in a 0° position.
Figure 9B:
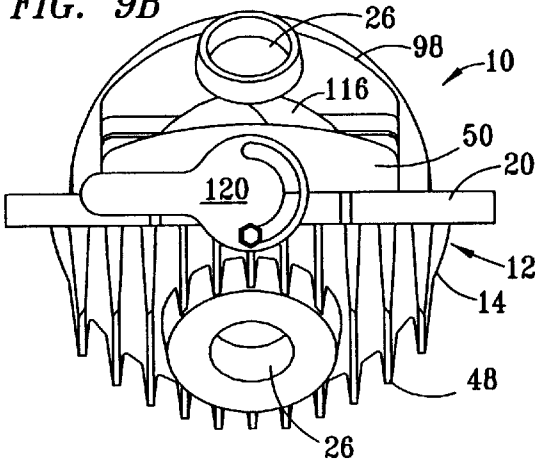
FIG. 9B is a front elevational view of the pump of FIG. 9A.

FIGS. 10A–10E show sequenced views of the pump 10 in operation with the control lever 120 in the 0° position as the input shaft is rotated through 180° of revolution. For ease in describing the operation, the opposing secondary vanes are labeled 98A, 98B, with the opposing primary vanes being designated 50A, 50B. As shown in FIGS. 9A and 9C, as the input shaft 32 is rotated, the primary and secondary vanes assemblies 52, 54 are rotated about the primary axis 33 within the housing interior 18. Because the secondary vane assembly 54 is pivotally mounted to the carrier ring 116 by means of pivot posts 118, the secondary vane assembly 54 causes the carrier ring 116 to rotate on the carrier ring shaft 104 (not shown) about the carrier ring axis 245. Because the carrier ring axis 245 is oriented at an oblique angle with respect to the primary axis 33, the carrier ring 116 causes each secondary vane 98A, 98B to reciprocate or move back and forth between a fully open position and a fully closed position.

FIG. 10A shows the pump 10 with the secondary vane 98A in the fully closed position with respect to primary vane 50A. In the fully closed position, the secondary vane 98A abuts against or is in close proximity to the primary vane 50A, so that the volume therebetween is minimal. In contrast, with respect to the opposing primary vane 50B, the vane 98A is in a fully open position so that the space between the vanes 98A and 50B is at its maximum. Any fluid within the space between vanes 98A, 50A is fully discharged through the port 26 of the upper housing. There is a slight overlap or communication of the interfacing primary and secondary vanes 50A, 98A with the port 26 along its edge when in the fully closed position to accomplish this. In the preferred embodiment, the primary vanes 50A, 50B are sized to completely cover and seal the ports 24, 26 so that slight rotation beyond this point causes the primary vanes 50A, 50B to close off communication with the chambers 248, 250 momentarily during rotation.

FIG. 10B illustrates the pump 10 with the shaft 32 rotated approximately 45° from that of FIG. 10A. Here the secondary vane 98A begins to move to the open position with respect to the primary vane 50A. This draws fluid into the opening space through the lower inlet port 26 of the lower housing 14. The secondary vane 98B also begins to move to the closed position with respect to the primary vane 50A. Fluid located in the chamber between the primary vane 50A and secondary 98 is thus compressed or forced out of the upper discharge port 26 of the upper housing 16.

In a like manner, fluid located between the secondary vane 98A and primary vane 50B is discharged through the lower port 24 of the lower housing 14, as the secondary vane 98A begins to move to the closed position with respect to the primary vane 50B. Fluid is also drawn through the inlet port 24 of the upper housing 16 as the secondary vane 98B is moved towards an open position with respect to the primary vane 50B.

FIGS. 10C and 10D show further rotation of the shaft 32 in approximately 45° increments. When the fixed shaft 100 is in the 0° position, the timing is such that the chambers created by the primary and secondary vanes 50, 98 remain in continuous communication with ports 24, 26 during generally the entire stroke of the vane 50 between the closed and open positions. In this way fluid continues to be drawn into or discharged from the chambers as the secondary vanes 98 are moved to either the open or closed positions during rotation of the shaft 32.

FIG. 10E shows the pump 10 after the shaft 32 is rotated 180°. The secondary vane 98B is in the fully closed position with respect to the primary vane 50A, just as the secondary vane 98A was when the shaft 32 was at the 0° position in FIG. 10A. By continuing to rotate the shaft 32, the process is repeated so that the fluid is taken into the pump, compressed and discharged by the reciprocation of the secondary vane between the open and closed positions, which is caused by the rotation of the carrier ring 116 about its oblique axis 246.

Figure 11C:
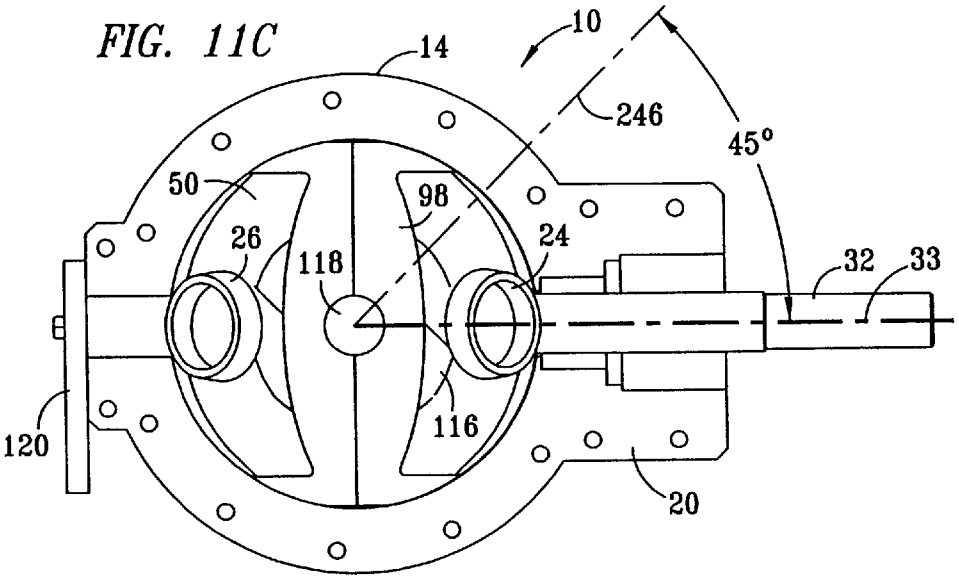
FIG. 11C is a top plan view of the pump of FIG. 11A.
Figure 11D:
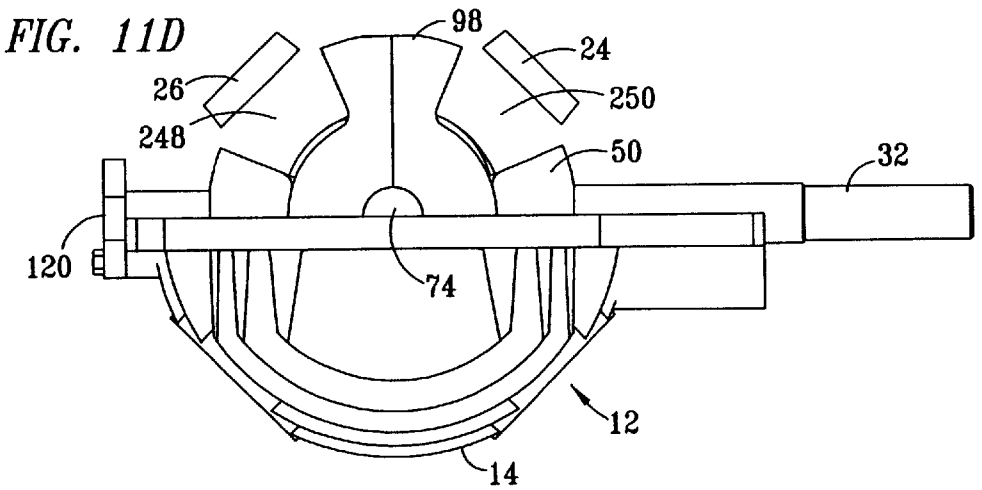
FIG. 11D is a side elevational view of the pump of FIG. 11A.
Figure 11A:
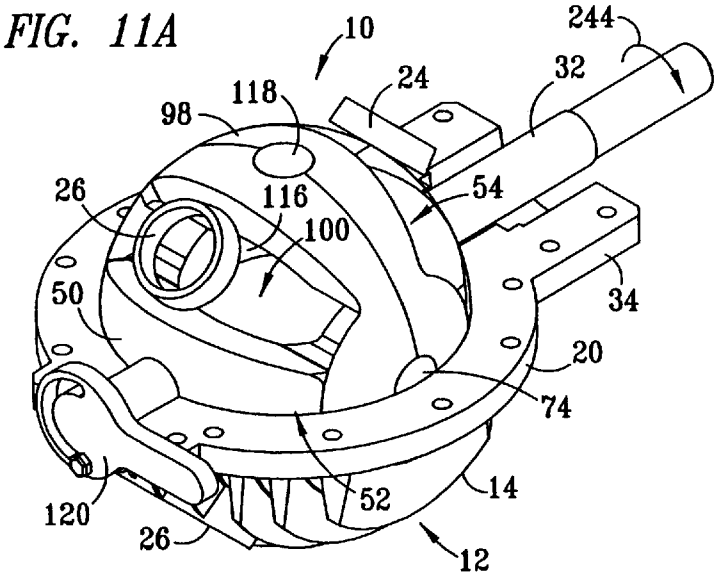
FIG. 11A is a perspective view of the pump of FIG. 1 shown with the upper half of the housing removed and the control lever in a 180° position.
Figure 11B:
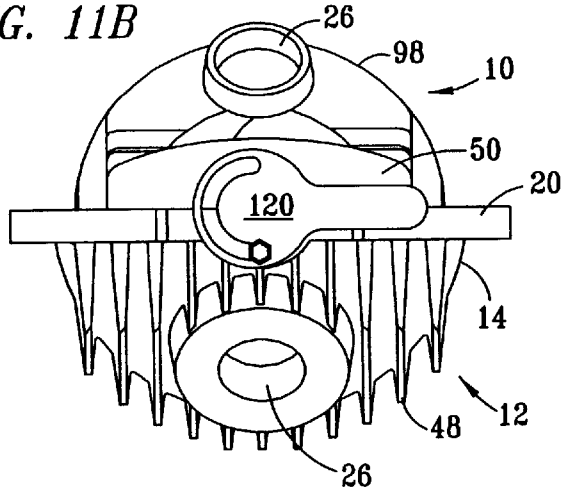
FIG. 11B is a front elevational view of the pump of FIG. 11A.
Figure 13C:
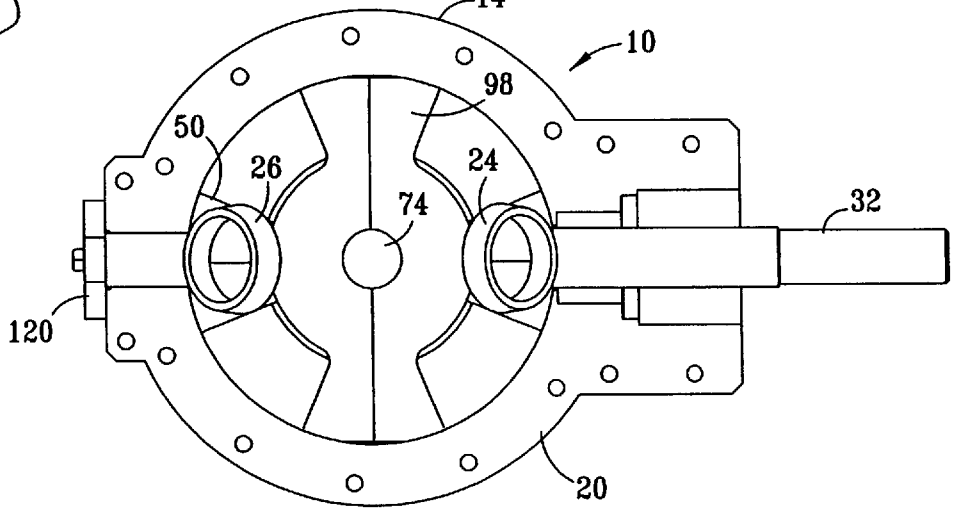
FIG. 13C is a top plan view of the pump of FIG. 13A.
Figure 13D:
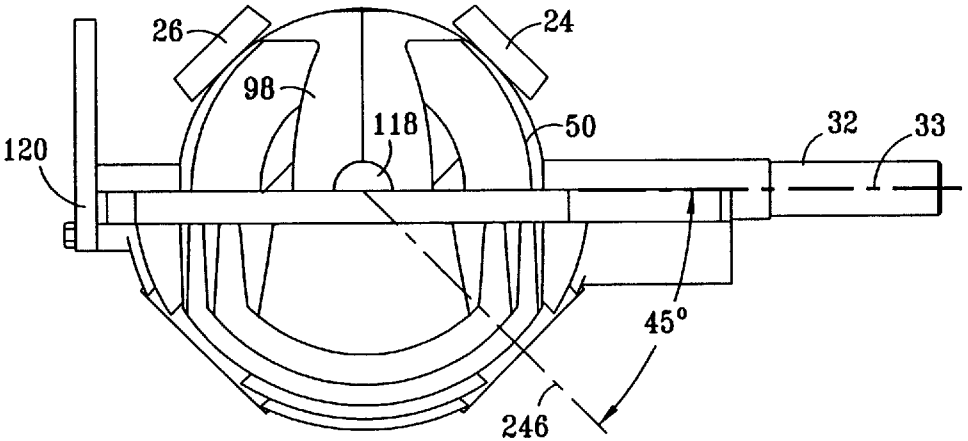
FIG. 13D is a side elevational view of the pump of FIG. 13A.
Figure 13A:
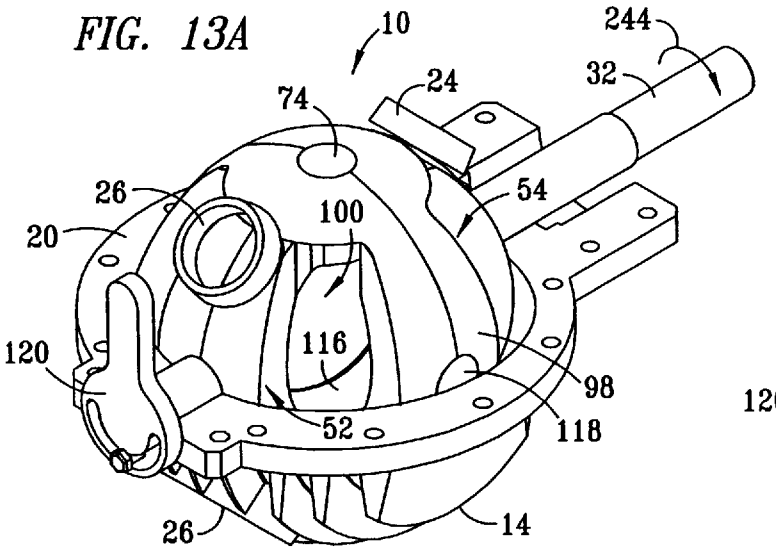
FIG. 13A is a perspective view of the pump of FIG. 1 shown with the upper half of the housing removed and the control lever in a 90° or neutral position.
Figure 13B:
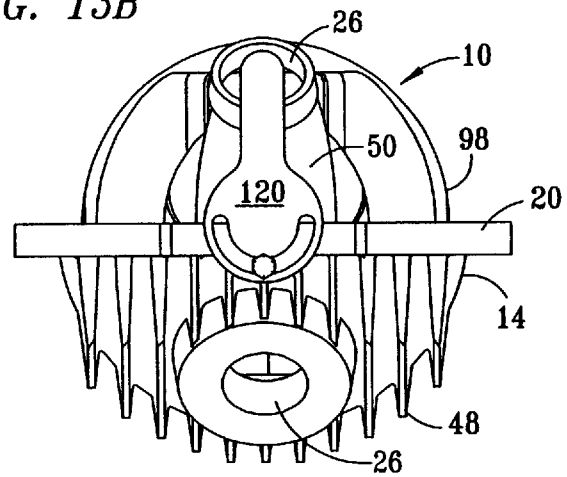
FIG. 13B is a front elevational view of the pump of FIG. 13A.

By rotating the fixed shaft 100 to different fixed positions, the flow of fluid through the pump 10 can be adjusted and even reversed without changing the direction of rotation of the input shaft 32. FIG. 11A shows the pump 10 with the lever 120 rotated fully 180° from the 0° position of FIGS. 9A–9D. In this position, the fixed shaft assembly 100 is oriented so that the carrier ring axis 246 is oriented at an approximately 45° angle to the left of the primary axis 33, as viewed in FIG. 11C, or about 90° from that orientation of the axis 246 as shown in FIG. 9C. In this position, the control plane 247 lies in a substantially horizontal plane that is generally the same or parallel to the plane of the flanges 20 which bisect the housing 12.

In the configuration of FIGS. 11A–11D, the forward port 26 of the upper housing 16 and the port 24 of the lower housing 14 serve as intake ports, while the port 24 of the upper housing 16 and the port 26 of the lower housing 14 serve as discharge ports.

FIGS. 12A–12E show sequenced views of the pump 10, with the control lever 120 rotated to the 180° position, as the input shaft 32 is rotated through 180° of rotation. In FIG. 12A, the pump 10 is shown with the secondary vane 98A in the fully closed position against the primary vane 50A. The vane 98A is also in a fully open position with respect to primary vane 50B. Referring to FIG. 12B, as the input shaft 32 is rotated, as shown by the arrow, the secondary vane 98A begins to move to the open position with respect to the primary vane 50A. The space or chamber formed between the secondary vane 98A and vane 50A is in continuous communication with the port 26 of the upper housing 16 as it is moved to the open position. The increasing volume of this chamber as the shaft 32 is rotated, as shown in FIGS. 12C and 12D, draws fluid through the upper forward port 26. As this is occurring, the secondary vane 98B moves to the closed position with respect to the primary vane 50A forcing fluid between these vanes 98B, 50A through the forward port 26 of the lower housing 14.

FIG. 12E shows the pump after the shaft 32 is rotated 180°. The secondary vane 98B is now in the closed position with respect to the primary vane 50A so that the process can be repeated. With the lever 120 in the 180° position, fluid is also discharged through rearward port 24 in the upper housing 16 and introduced through rearward port 24 of the lower housing 14 in the similar manner as that already described with respect to the forward ports 26. The ports 24, 26 remain in generally constant communication with one of the chambers created by the vanes 50, 98 during the entire stroke of the vane 98 between the open and closed positions.

FIGS. 13A–13D illustrate the pump 10 in an intermediate or neutral mode, with the control lever 120 oriented at an upright 90° position. In this position, the fixed shaft assembly 100 is oriented so that the carrier ring axis 246 lies in a plane perpendicular to the housing flanges 20 and is oriented at an angle of 45° below the primary axis 33, as viewed in FIG. 13D. In this orientation, the control plane 247 is in the 90° or vertical position, as seen in FIG. 8C. In this mode, the ports 24, 26 only communicate approximately 50% of the time with the chambers created by the vanes 50, 98.

FIG. 14A shows the secondary vane 98 in a center or intermediate position, with the primary vane 50 oriented so that it covers and seals the ports 24, 26. As the input shaft 32 rotates from this intermediate position, as shown in FIG. 14B, the port 26 of the upper housing 16 begins to communicate with the chamber between secondary vane 98B and primary vane 50A, and the port 26 of the lower housing 14 communicates with the chamber between the secondary vane 98A and primary vane 50A. As the secondary vane 98B is moved towards the open position with respect to the primary vane 50A, some fluid is drawn through the port 26 of the upper housing 16. In a similar manner, the secondary vane 98A is moved to the closed position with respect to the primary vane 50A so fluid therein is forced out of the lower port 26.

FIG. 14C shows the secondary vane 98B in the fully open position with respect to the primary vane 50A. The secondary vane 98A, which is hidden from view, is in the fully closed position with respect to primary vane 50A, with the closed space between the primary vane 50A and secondary vane 98A being in communication with the lower forward port 26 of the lower housing 14.

As the shaft 32 is rotated further, as seen in FIG. 14D, some fluid is forced out of the upper housing 16 through port 26 as the secondary vane 98B now moves to the closed position with respect to vane 50A. Fluid is also drawn in through the lower port 26 as the secondary vane 98A is moving to the open position in relation to the primary vane 50A.

FIG. 14E shows the pump 10 after rotation of the shaft 32 180° from its original position of FIG. 14A. The secondary vane 98 is once again in the intermediate position, like that of FIG. 14A, and the process is repeated. With the control lever 120 in the 90° position, as described, the ports 26 of the lower and upper housing 14, 16 only communicate with the chambers defined by the primary and secondary vanes 50, 98 approximately 50% of the time. This results in equal volumes of fluid being both drawn and discharged through each of the forward ports 26 in the upper and lower housing during this neutral mode. The operation is the same with respect to the fluid flow through the rearward ports 24 in the lower and upper housing 14, 16. The net fluid flow through the pump 10 is therefore essentially zero.

By rotating the control lever 120 between the 0° and 180° positions, the fluid flow can be increased or decreased precisely in a smooth and continuous manner, and can be directed in either flow direction. This is due to the increased amount of time the inlet ports and outlet ports communicate with the chambers 248, 250 formed by the vanes 50, 98 during the expansion and compression strokes, respectively, of the secondary vane 98. Thus, for example, as the lever 120 is rotated from the 90° or neutral position towards the 0° position of FIG. 10A, the length of time the forward port 26 of the upper housing 16 communicates with the chamber formed by the primary vane 50A and secondary vanes 98, as the secondary vanes 98 are moved to the closed position, is lengthened, resulting in more and more fluid flow through this port. As described previously, when the lever is at the full 0° position, the port 26 of the upper housing 16 is in communication with the chamber formed by the primary vane 50A and secondary vanes 98 during almost the entire compression stroke of the secondary vanes 98 with respect to the vane 50A so that full flow is achieved when the pump 10 is in this mode. Similar results in the reverse-flow direction are achieved by rotating the lever 120 between the 90° and the 180° position, which is shown in FIG. 12A.

Figure 15:
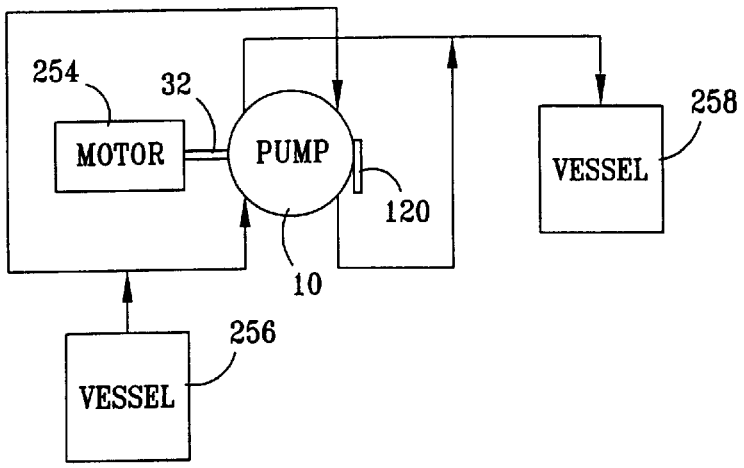
FIG. 15 is a schematic representation of a fluid system utilizing the pump of the invention with fluid flow in a given direction.
Figure 16:
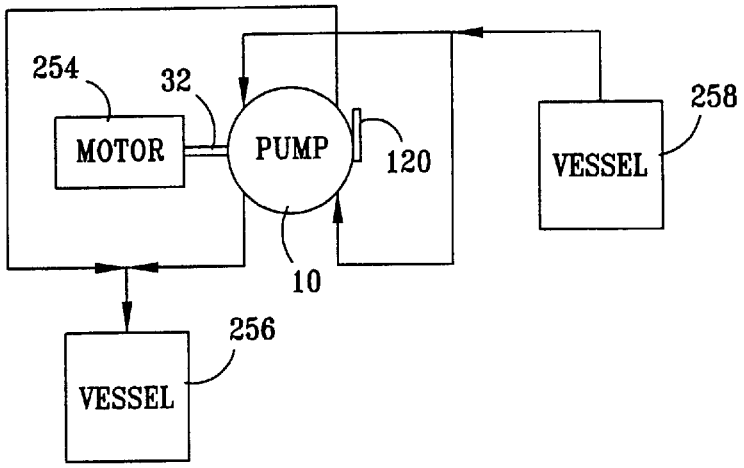
FIG. 16 is a schematic representation of a fluid system utilizing the pump of the invention with fluid flow in a reverse direction from that of FIG. 15 by rotation of the control lever.
Figure 17:
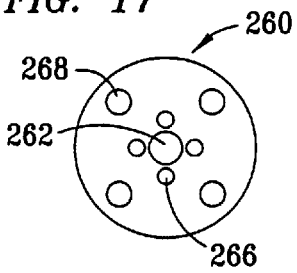
FIG. 17 is an elevational view of a flow capacity control plate for use with the pump of FIG. 1 for mounting the fixed shaft assembly in different fixed positions, and constructed in accordance with the invention.

FIGS. 15 and 16 show the pump 10 used in different fluid flow systems. As shown in FIG. 15, the pump 10 is powered by a suitable motor 254 that rotates the input shaft 32 of the pump. The pump 10 is connected to a fluid reservoir or vessel 256. Here, the lever 120 is oriented in the 0° position. As the pump 10 is operated, fluid is pumped from the vessel 256 to the storage vessel 258. FIG. 16 shows generally the same system, except that the lever 120 is rotated 180° so that reverse fluid flow is achieved, while the motor 254 continues to rotate the input shaft 32 in the same direction as that of FIG. 15.

Figure 18:
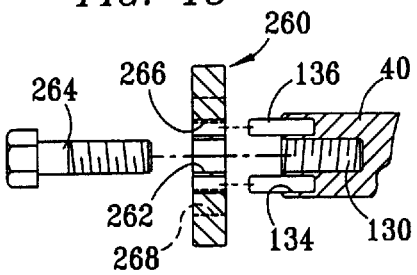
FIG. 18 is a cross-sectional side view of the control plate of FIG. 17 and the fixed shaft assembly of the pump of FIG. 1, with the control plate exploded away from the fixed shaft assembly to illustrate how the control plate is mounted.

FIGS. 17–21 illustrate another embodiment wherein a fluid capacity control plate 260 is used instead of the control lever 120. The control plate 260 is a flat, circular metal plate having a central bolt hole 262 for receiving a bolt 264 (FIG. 18). The bolt 264 is used to secure the control plate 260 to the fixed shaft 40 of the fixed shaft assembly 100 by means of the threaded bolt hole 130 formed in the fixed shaft 40. Dowel holes 266 are formed in the plate 260 around the bolt hole 262 and correspond to the dowel holes 134 of the fixed shaft 40 for receiving dowels 136. The dowel holes 266 are circumferentially spaced 90° apart. The dowels 136 received within the dowel holes 266 prevent relative rotation of the control plate 260 with respect to the shaft 40.

Figure 20:
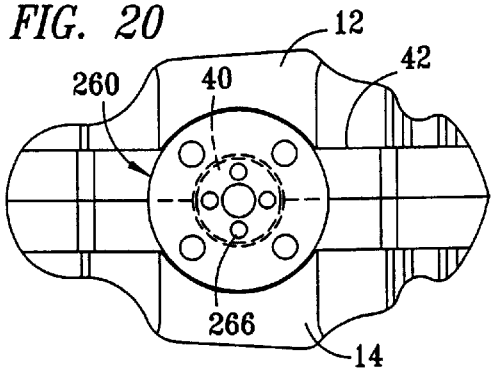
FIG. 20 is an elevational view of the control plate of FIG. 17, shown mounted to the housing of the pump of FIG. 1.

Formed along the perimeter of the plate 260 are spaced apart bolt holes 268. The bolt holes 268 are configured to overlay the threaded bolt holes 270 (FIGS. 1 and 2) formed in the neck piece 42 of the housing 12. As shown in FIG. 20, the dowel holes 266 are generally aligned along vertical and horizontal lines when the plate 260 is mounted to the neck portion 42 of the housing 12.

Using the control plate 260, the fixed shaft assembly 100 can be rotated to different fixed positions in 90° increments with respect to the housing 12 by repositioning and bolting the control plate 260 to the housing 12.

Figure 19:
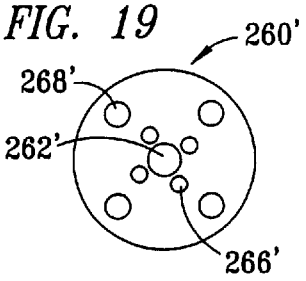
FIG. 19 is a top plan view of another flow capacity control plate for use with the pump of FIG. 1, shown with dowel holes of the control plate in a different orientation, and constructed in accordance with the invention.
Figure 21:
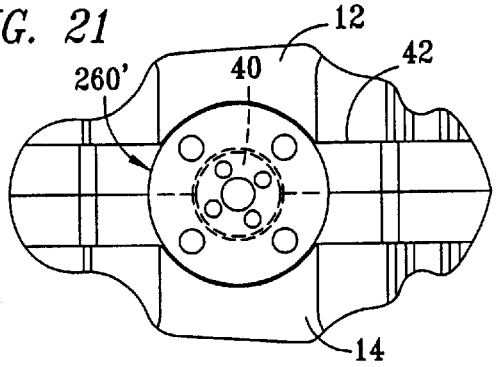
FIG. 21 is an elevational view of the control plate of FIG. 19, shown mounted to the housing of the pump of FIG. 1.

FIG. 19 shows another control plate 260'. The control plate 260' is generally the same as the plate 260 of FIG. 17, with like components having the same numeral designated with a prime symbol. The control plate 260' has the four dowel holes 266' aligned at approximately 30° from the vertical and horizontal positions when the plate 260' is mounted to the housing 12, as shown in FIG. 21. The plate 260' may even be reversed so that the underside faces outwards. This orients the dowel holes 266 so that they are approximately 60° from the vertical and horizontal positions As will be appreciated by those skilled in the art, many different control plates having different dowel hole configurations may be provided with the pump 10 to orient the fixed shaft assembly 100 to provide the optimal compression or fluid flow.

Although not shown, other means could be provided for rotating the fixed shaft assembly 100. For instance, the shaft 40 could be coupled to a worm and worm gear to rotate the fixed shaft to various positions. This in turn could be coupled to a controller that would cause the fixed shaft assembly to be rotated to automatically control and adjust the fluid flow or capacity of the pump 10.

Figure 23:
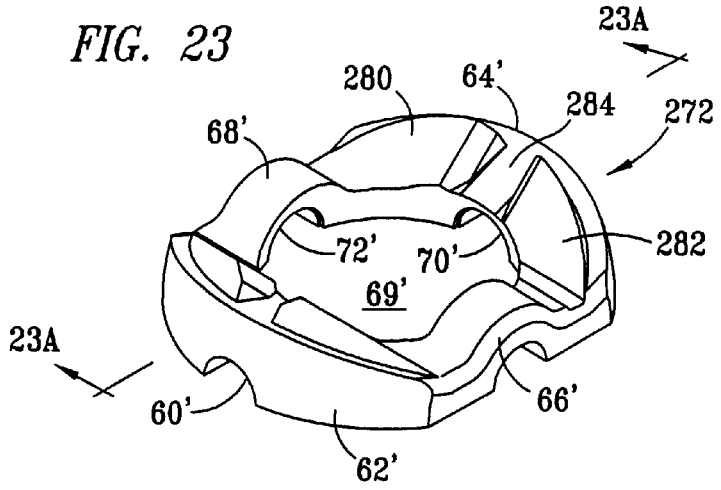
FIG. 23 is a perspective view of a primary vane half of a primary vane assembly for use in cooperation with the secondary vane half of FIG. 22, and constructed in accordance with the invention.
Figure 23A:
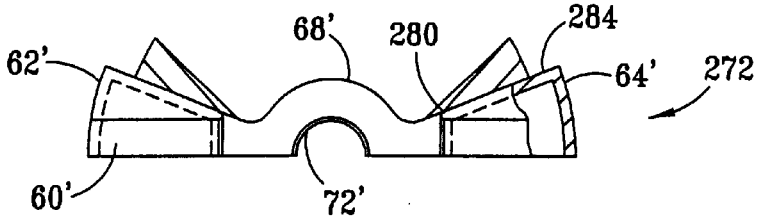
FIG. 23A is an elevational view of the primary vane half along line 23A—23A of FIG. 23.

In another embodiment, the vanes may be configured with recesses or hollowed out areas to reduce the weight of the vane, as shown in FIG. 23A. This is particularly important with respect to the secondary vane because the secondary vane is both rotated and reciprocated along the primary axis. Because the secondary vane is reciprocated between the open and closed positions, it undergoes numerous and rapid changes in angular velocity during operation. The inertial forces created by these changes in angular velocity place a large amount of stress on the vane. By reducing the weight of the vane, the inertial forces can be reduced. This is particularly advantageous in pumps that operate at high speed and low pressures.

Figure 22:
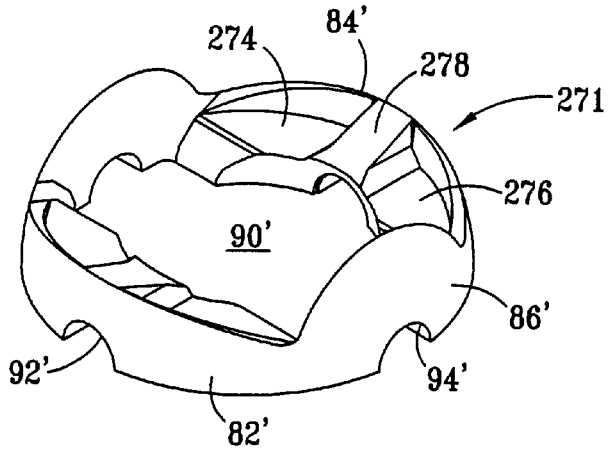
FIG. 22 is a perspective view of another embodiment of a secondary vane half for a secondary vane assembly, constructed in accordance with the invention.

FIGS. 22, and 23 illustrate primary and secondary vane halves 271, 272, respectively. The primary and secondary vane halves 277, 272 are similar to the vane halves 56, 58, 76 and 78, with similar components numbered the same and designated with a prime symbol. Although only one of the primary and secondary vane halves is shown, the other matching vane half would be similarly constructed.

As can be seen in FIG. 22, the secondary vane half 271, used for the reciprocating secondary vane, is provided with recessed or cutout areas 274, 276 in the outer surface of the vane members 82', 84' to provide a reduction in weight. A central rib 278 divides the recessed areas 274, 276 and provides structural support to strengthen the vane members 82', 84'. The rib 278 increases in thickness from the inward end to the outer end of the vane members 82', 84'. This creates greater strength near the outer extent of the vane member where it is most needed due to the higher velocity and centrifugal forces encountered near the ends of the vanes.

As shown in FIG. 22, the primary vane half 272 is constructed to correspond to the configuration of the secondary vane half 271. The primary vane members 62', 64' each have projecting members 280, 282, which are shaped to be closely received within the recesses 274, 276 of the secondary vanes. A channel 284 formed between the members 280, 282 receives the rib 278.

The pump 10 may be used as a compressor for compressing compressible fluids. When used in this mode, a check valve (not shown) can be coupled to the discharge ports or the discharge ports can be provided with valves (not shown) timed to open during a given point in the compression stroke of the vanes so that the desired compression is achieved. It may also be possible to provide pre-compression within the pump 10 itself by delaying communication of the chambers between the vanes during the compression stroke. This may be accomplished by configuring the primary vane or the outlet port itself so that communication with the compression chamber formed by the vanes is delayed during the compression stroke. By rotating the fixed shaft assembly to different positions, as already described, the compression and fluid flow can also be adjusted.

The pump 10 may also be used to pump incompressible or hydraulic fluids. When the pump 10 is fluid tight so that there is substantially no fluid slippage across the vanes, the timing should be set so that the outlet ports are in communication with the compression chamber during the entire compression stroke, such as when the control lever is in one of the full flow modes, i.e. the full 0° or 180° positions as previously described. Otherwise, the possibility of fluid lock may occur as the vanes act on the fluid. It may also be possible to configure the pump so that some slippage of fluid flow across the vanes occurs during operation to avoid such hydraulic fluid lock. In such cases, the communication of the outlet ports with the compression chambers could be delayed to some degree without the occurrence of fluid lock.

The device 10 could also function as a motor wherein pressurized fluids are introduced into the device and then exhausted. The operation would be reversed so that the action of the expanding or pressurized fluids introduced into the pump would act upon the vanes to thus turn or rotate the shaft 32.

The fluid device of the invention has several advantages. The pump itself is highly efficient, pumping substantially twice the free volume of the pump interior for every revolution of the input shaft, when used in the full flow mode. The device does not need to be primed, as in many prior art devices. It can be used for many different applications and with a variety of different fluids, both compressible and noncompressible. It can be used as a vacuum pump. The device may even be used as a motor.

In prior art spherical pumps, the vane assemblies had to be positioned and oriented properly during manufacture to ensure proper timing of suction and discharge and to ensure proper operation of the pump. This timing could not be varied after the pump was assembled. Further, the flow of fluid could not be changed other than by varying the speed at which the drive shaft was rotated. The device of the present invention allows the timing or pump capacity to be easily and simply controlled with a greater degree of precision by adjusted or rotating the orientation of the fixed shaft assembly and without adjusting or varying the rotation of the drive or input shaft. Further, the timing can be adjusted easily after the pump is manufactured and fully assembled. The direction of fluid flow can even be reversed during operation and without altering the direction of rotation of the input shaft. Both the lever 120 and control plate 260 provide an easy means for orienting the fixed shaft assembly and adjusting and ensuring the proper timing of suction and discharge. It should be noted that although the race assembly is shown located within the center of the housing interior to guide the reciprocating secondary vane as the secondary vane is rotated about the race assembly, a race assembly could also be employed that is exterior to the secondary vane, with a carrier ring that is positionable at various positions exterior to the secondary vane.

The pump employs other advantages, such as the ribs or fins of the outer housing that reduce weight and provide increased surface area for heat transfer. The hollowed or recessed secondary vanes, which reduce the weight of the vane, also contribute to the smooth and efficient operation of the device.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

I claim:

1. A fluid machine comprising:

a housing having a wall defining an interior, the housing having a port in communication with the interior of the housing;

a first shaft mounted for rotation relative to the housing about a primary axis, wherein at least a portion of the first shaft extends through the housing wall;

at least one primary vane coupled to the first shaft, and disposed within the interior of the housing that rotates about the primary axis of the first shaft;

a second shaft extending into the interior of the housing and mounted to the housing for rotation about the axis of the second shaft;

at least one secondary vane disposed within the interior of the housing and mounted to the second shaft, the axis of the second shaft being fixed relative to the primary axis of the first shaft, and the secondary vane pivotally oscillating between alternating relatively open and closed positions with respect to the primary vane and defining a chamber within the housing interior having a volume which varies as the primary vane is rotated about the primary axis; and an adjustable vane guide bearing member disposed within the housing and coupled to the second shaft, the adjustable vane guide bearing member oscillating the secondary vane between relatively open and closed positions relative to the primary vane, varying the point during rotation of the first shaft and the primary vane at which the secondary vane reaches the relatively open and closed positions relative to the housing and the port so that the flow of fluid between the port and the chamber is adjusted.

2. The fluid machine of claim 1, wherein the vane guide bearing member varies the point during rotation of the primary vane at which the secondary vane reaches the open and closed positions so that the rate of fluid flow through the machine is varied.

3. The fluid machine of claim 1, wherein the vane guide bearing member varies the point during rotation of the primary vane at which the secondary vane reaches the open and closed positions so that the direction of fluid flow through the machine is reversed while the direction of rotation of the primary vane remains substantially constant.

4. The fluid machine of claim 1, wherein:

the vane guide bearing member includes a control member extending outside the housing that is adjusted relative to the housing to varying the point during rotation of the primary vane at which the secondary vane reaches the open and closed positions so that the degree of communication of the port with the chamber is adjusted.

5. The fluid machine of claim 4, wherein:

the control member is a control plate which couples to the housing.

6. The fluid machine of claim 4, wherein:

the control member is a control lever.

7. The fluid machine of claim 1, wherein there are two ports formed in the housing.

8. The fluid machine of claim 1, wherein at least a substantial portion of the secondary vane is hollow.

9. The fluid machine of claim 1, wherein the secondary vane is formed as two halves that are joined together, and wherein at least one of the secondary vane halves has recessed areas formed therein.

10. The fluid machine of claim 1, wherein the exterior of the housing is contoured to provide increased surface area to facilitate cooling of the machine.

11. The fluid machine of claim 1, wherein the exterior of the housing is provided with a plurality of outwardly projecting ribs.

12. The fluid machine of claim 1, wherein the fluid machine is a motor.

13. The fluid machine of claim 1, wherein the fluid machine is a fluid pump.

14. The fluid machine of claim 1, wherein the fluid machine is a fluid compressor.

15. The fluid machine of claim 1, wherein the vane guide bearing member varies the point during rotation of the primary vane at which the secondary vane reaches the open and closed positions so that the rate of fluid flow through the machine is adjusted while the direction of rotation of the primary vane remains substantially constant.

16. The fluid machine of claim 1, wherein:

the vane guide bearing member is adjustable to vary the lower limit of the size of the volume of the chamber defined by the primary and secondary vanes that is in communication with the port.

17. The fluid machine of claim 1, wherein the adjustable vane guide bearing member varies the point during rotation of the first shaft and the primary vane at which the secondary vane reaches the relatively open and closed positions relative to the housing and the port by rotating the second shaft about the axis of the second shaft.

18. A fluid machine comprising:

a housing having a wall defining an interior, the housing having a port in communication with the interior of the housing;

a first shaft;

at least one primary vane disposed within the interior of the housing that rotates about a primary axis of the first shaft;

at least one secondary vane disposed within the interior of the housing, the secondary vane pivotally mounted to the primary vane and oscillating between alternating relatively open and closed positions with respect to the primary vane, the primary vane, the secondary vane, and the housing defining a chamber having a volume which varies as the primary vane is rotated about the primary axis;

a second shaft mounted to the housing for rotation about the axis of the second shaft, wherein the axis of the second shaft is fixed relative to the primary axis of the first shaft; and a vane guide bearing member, wherein the vane guide bearing member is mounted on the second shaft, the vane guide bearing member oscillates the secondary vane between open and closed positions, and the vane guide bearing member is adjustable to vary the lower limit of the size of the volume of the chamber defined by the primary and secondary vane that is in communication with the port.

19. A fluid machine comprising:

a housing defining an interior, the housing having at least two fluid ports in communication with the interior of the housing;

a primary vane disposed within the interior of the housing;

a rotary shaft having a primary axis that couples to the primary vane and rotates the primary vane about the primary axis;

a secondary vane mounted within the housing for pivotal movement between relatively open and closed positions with respect to the primary vane, the secondary vane pivoting about a pivotal axis passing through the primary vane as the primary vane rotates, the primary and secondary vanes dividing the interior of the housing into chambers with the volume of the chambers varying as the secondary vane is moved between the open and closed positions;

a second shaft mounted to the secondary vane, wherein the axis of the second shaft is fixed relative to the primary axis of the rotary shaft;

a guide mounted to and disposed within the housing that causes the secondary vane to oscillate between the relatively open and closed positions and directs diametrically opposed points of the secondary vane to rotate about a secondary vane rotational axis that intersects but which is angularly offset from the primary axis as the primary vane is rotated, the primary axis and secondary vane rotational axis defining a control plane; and wherein the guide can be adjusted to orient the secondary vane rotational axis and thus the control plane in two or more positions so that communication of the ports with the chambers is adjusted to thereby regulate fluid flow through the machine.

20. The fluid machine of claim 19, wherein the rate of fluid flow through the machine is varied by adjusting the orientation of the control plane.

21. The fluid machine of claim 19, wherein the direction of fluid flow through the machine is reversed by adjusting the orientation of the control plane while the direction of rotation of the primary vane remains substantially constant.

22. The fluid machine of claim 19, wherein the rate of fluid flow through the machine is adjusted by adjusting the orientation of the control plane while the direction of rotation of the primary vane remains substantially constant.

23. The fluid machine of claim 17, wherein the guide can be adjusted to orient the secondary vane rotational axis by rotating the second shaft about the axis of the second shaft.

24. A fluid machine comprising:

a housing defining a generally spherical interior, the housing having a fluid inlet and a fluid outlet in communication with the interior of the housing;

a primary vane disposed within the interior of the housing;

a rotary shaft having a primary axis of rotation mounted to the housing, the primary vane being coupled to the rotary shaft so that the primary vane is rotated about the primary axis by the rotary shaft;

a fixed shaft which extends into the interior of the housing opposite the rotary shaft, the fixed shaft having a spherical end portion about which the primary vane rotates, the fixed shaft being adjustably mounted to the housing so that the fixed shaft can be oriented in various fixed positions;

a carrier ring rotatably carried on the spherical end portion of the fixed shaft, the axis of rotation of the carrier ring being oriented at an oblique angle in relation to the primary axis;

a secondary vane pivotally mounted to the primary vane so that the secondary vane is pivotal about an axis perpendicular to the primary axis to allow the secondary vane to pivot between open and closed positions with respect to the primary vane as the primary and secondary vanes are rotated together by the rotary shaft about the primary axis, the primary and secondary vanes dividing the interior of the housing into chambers with the volume of the chambers varying as the secondary vane is moved between the open and closed positions, the secondary vane being pivotally coupled to the carrier ring so that the secondary vane is pivotal about an axis perpendicular to the axis of rotation of the carrier ring, the rotation of the carrier ring causing the secondary vane to reciprocate between the open and closed positions as the secondary vane is rotated about the primary axis by the rotary shaft; and wherein the degree of communication of the inlet and outlet ports with the chambers is adjusted by moving the fixed shaft to a different fixed position.

25. The fluid machine of claim 24, wherein the rate of fluid flow through the machine is adjusted by varying the position of the fixed shaft.

26. The fluid machine of claim 24, wherein the direction of fluid flow through the machine is reversed by varying the position of the fixed shaft while the direction of rotation of the rotary shaft remains substantially constant.

27. The fluid machine of claim 24, wherein:

the fixed shaft is rotatably mounted to the housing; and further comprising:

a control lever coupled to the fixed shaft for selectively rotating the fixed shaft to the various fixed positions.

28. The fluid machine of claim 24, further comprising a control member that couples to the fixed shaft for maintaining the fixed shaft at a selected fixed position.

29. The fluid machine of claim 24, wherein there are two inlets and two outlets formed in the housing.

30. The fluid machine of claim 24, wherein at least a substantial portion of the secondary vane is hollow.

31. The fluid machine of claim 24, wherein the secondary vane is formed as two halves that are joined together, and wherein at least one of the secondary vane halves has recessed areas formed therein.

32. The fluid machine of claim 24, wherein the primary and secondary vanes divide the interior of the housing into four chambers.

33. The fluid machine of claim 24, wherein the secondary vane is pivotally mounted to the rotary shaft by pivotally coupling the secondary vane to the primary vane.

34. The fluid machine of claim 24, wherein the fixed shaft is moved to the various fixed positions by rotating the fixed shaft about an axis coaxial with the primary axis.

35. The fluid machine of claim 24, wherein the exterior of the housing is contoured to provide increased surface area to facilitate cooling of the machine.

36. The fluid machine of claim 24, wherein the exterior of the housing is provided with a plurality of outwardly projecting ribs.

37. The fluid machine of claim 24, wherein the fluid machine is a motor.

38. The fluid machine of claim 24, wherein the fluid machine is a fluid pump.

39. The fluid machine of claim 24, wherein the fluid machine is a fluid compressor.

40. The fluid machine of claim 24, wherein the rate of fluid flow through the machine is adjusted by varying the position of the fixed shaft, while the rotary shaft is rotated at a generally constant rate.

41. A fluid machine comprising:

a housing having a wall defining an interior, the housing having a port in communication with the interior of the housing;

a first shaft mounted for rotation relative to the housing about a primary axis, wherein at least a portion of the first shaft extends through the housing wall, and wherein the primary axis is immovable relative to the housing;

at least one primary vane disposed within the interior of the housing that rotates about the primary axis of the first shaft;

at least one secondary vane disposed within the interior of the housing and mounted to the primary vane, the secondary vane pivotally oscillating between alternating open and closed positions with respect to the primary vane and defining a chamber within the housing interior having a volume which varies as the primary vane is rotated about the primary axis; and an adjustable vane guide bearing member disposed within the housing, wherein the adjustable vane guide bearing member oscillates the secondary vane between relatively open and closed positions in response to rotation of the primary vane relative to the primary vane, varying the point during rotation of the first shaft and the primary vane at which the secondary vane reaches the relatively open and closed positions relative to the housing and the port so that communication of the port with the chamber is adjusted.

42. The fluid machine of claim 41, wherein the vane guide bearing member varies the point during rotation of the primary vane at which the secondary vane reaches the open and closed positions so that the rate of fluid flow through the machine is varied.

43. The fluid machine of claim 41, wherein the vane guide bearing member varies the point during rotation of the primary vane at which the secondary vane reaches the open and closed positions so that the direction of fluid flow through the machine is reversed while the direction of rotation of the primary vane remains substantially constant.

44. The fluid machine of claim 41, wherein:

the vane guide bearing member includes a control member extending outside the housing that is adjusted relative to the housing to varying the point during rotation of the primary vane at which the secondary vane reaches the open and closed positions so that the degree of communication of the port with the chamber is adjusted.

45. The fluid machine of claim 44, wherein:

the control member is a control plate which couples to the housing.

46. The fluid machine of claim 44, wherein:

the control member is a control lever.

47. The fluid machine of claim 41, wherein there are two ports formed in the housing.

48. The fluid machine of claim 41, wherein at least a substantial portion of the secondary vane is hollow.

49. The fluid machine of claim 41, wherein the secondary vane is formed as two halves that are joined together, and wherein at least one of the secondary vane halves has recessed areas formed therein.

50. The fluid machine of claim 41, wherein the exterior of the housing is contoured to provide increased surface area to facilitate cooling of the machine.

51. The fluid machine of claim 41, wherein the exterior of the housing is provided with a plurality of outwardly projecting ribs.

52. The fluid machine of claim 41, wherein the fluid machine is a motor.

53. The fluid machine of claim 41, wherein the fluid machine is a fluid pump.

54. The fluid machine of claim 41, wherein the housing is spherical.

55. The fluid machine of claim 41, wherein the fluid machine is a fluid compressor.

56. The fluid machine of claim 41, wherein the vane guide bearing member varies the point during rotation of the primary vane at which the secondary vane reaches the open and closed positions so that the rate of fluid flow through the machine is adjusted while the direction of rotation of the primary vane remains substantially constant.

57. The fluid machine of claim 41, wherein:

the vane guide bearing member is adjustable to vary the lower limit of the size of the volume of the chamber defined by the primary and secondary vanes that is in communication with the port.

58. The fluid machine of claim 41, wherein the adjustable vane guide bearing member varies the point during rotation of the first shaft and the primary vane at which the secondary vane reaches the relatively open and closed positions relative to the housing and the port by rotating the second shaft about the axis of the second shaft.

59. A fluid machine comprising:

a housing having a wall defining an interior, the housing having a port in communication with the interior of the housing;

at least one primary vane disposed within the interior of the housing that rotates about a primary axis of a first shaft;

at least one secondary vane disposed within the interior of the housing and mounted to the primary vane, the secondary vane pivotally oscillating between alternating relatively open and closed positions with respect to the primary vane, the primary vane, the secondary vane, and the housing defining a chamber having a volume which varies as the primary vane is rotated about the primary axis;

a second shaft mounted to the housing for rotation about the longitudinal axis of the second shaft; and a vane guide bearing member, wherein the vane guide bearing member is mounted on the second shaft, the vane guide bearing member oscillates the secondary vane between relatively open and closed positions, and the vane guide bearing member is adjustable by rotation about the longitudinal axis of the second shaft to vary the lower limit of the size of the volume of the chamber defined by the primary and secondary vane that is in communication with the port.

60. A fluid machine comprising:

a housing defining an interior, the housing having at least two fluid ports in communication with the interior of the housing;

a primary vane disposed within the interior of the housing;

a rotary shaft having a primary axis that couples to the primary vane and rotates the primary vane about the primary axis, wherein the primary axis is immovable relative to the housing;

a secondary vane mounted to the primary vane and mounted within the housing for pivotal movement between relatively open and closed positions with respect to the primary vane, the secondary vane pivoting about a pivotal axis passing through the primary vane as the primary vane rotates, the primary and secondary vanes dividing the interior of the housing into chambers with the volume of the chambers varying as the secondary vane is moved between the open and closed positions;

a guide mounted to and disposed within the housing that causes the secondary vane to move between the relatively open and closed positions and directs diametrically opposed points of the secondary vane to rotate about a secondary vane rotational axis that intersects but which is angularly offset from the primary axis as the primary vane is rotated, the primary axis and secondary vane rotational axis defining a control plane; and wherein the guide can be adjusted to orient the secondary vane rotational axis and thus the control plane in two or more positions so that communication of the ports with the chambers is adjusted to thereby regulate fluid flow through the machine.

61. The fluid machine of claim 60, wherein the rate of fluid flow through the machine is varied by adjusting the orientation of the control plane.

62. The fluid machine of claim 60, wherein the direction of fluid flow through the machine is reversed by adjusting the orientation of the control plane while the direction of rotation of the primary vane remains substantially constant.

63. The fluid machine of claim 60, wherein the rate of fluid flow through the machine is adjusted by adjusting the orientation of the control plane while the direction of rotation of the primary vane remains substantially constant.

64. The fluid machine of claim 60, wherein the guide can be adjusted to orient the secondary vane rotational axis by rotating the second shaft about the axis of the second shaft.

65. A fluid machine comprising:

a housing defining a generally spherical interior, the housing having a fluid inlet and a fluid outlet in communication with the interior of the housing;

a primary vane disposed within the interior of the housing;

a rotary shaft having a primary axis of rotation mounted to the housing, the primary vane being coupled to the rotary shaft so that the primary vane is rotated about the primary axis by the rotary shaft;

a fixed shaft which extends into the interior of the housing opposite the rotary shaft, the fixed shaft having a spherical end portion about which the primary vane rotates, the fixed shaft being adjustably mounted to the housing so that the fixed shaft can be oriented in various fixed positions;

a carrier ring rotatably carried on the spherical end portion of the fixed shaft, the axis of rotation of the carrier ring being oriented at an oblique angle in relation to the primary axis;

a secondary vane pivotally mounted to the primary vane so that the secondary vane is pivotal about an axis perpendicular to the primary axis to allow the secondary vane to pivot between open and closed positions with respect to the primary vane as the primary and secondary vanes are rotated together by the rotary shaft about the primary axis, the primary and secondary vanes dividing the interior of the housing into chambers with the volume of the chambers varying as the secondary vane is moved between the open and closed positions, the secondary vane being pivotally coupled to the carrier ring so that the secondary vane is pivotal about an axis perpendicular to the axis of rotation of the carrier ring, the rotation of the carrier ring causing the secondary vane to reciprocate between the open and closed positions as the secondary vane is rotated about the primary axis by the rotary shaft; and wherein the degree of communication of the inlet and outlet ports with the chambers is adjusted by moving the fixed shaft to a different fixed position.

66. The fluid machine of claim 65, wherein the rate of fluid flow through the machine is adjusted by varying the position of the fixed shaft.

67. The fluid machine of claim 65, wherein the direction of fluid flow through the machine is reversed by varying the position of the fixed shaft while the direction of rotation of the rotary shaft remains substantially constant.

68. The fluid machine of claim 65, wherein:

the fixed shaft is rotatably mounted to the housing; and further comprising:

a control lever coupled to the fixed shaft for selectively rotating the fixed shaft to the various fixed positions.

69. The fluid machine of claim 65, further comprising a control member that couples to the fixed shaft for maintaining the fixed shaft at a selected fixed position.

70. The fluid machine of claim 65, wherein there are two inlets and two outlets formed in the housing.

71. The fluid machine of claim 65, wherein at least a substantial portion of the secondary vane is hollow.

72. The fluid machine of claim 65, wherein the secondary vane is formed as two halves that are joined together, and wherein at least one of the secondary vane halves has recessed areas formed therein.

73. The fluid machine of claim 65, wherein the primary and secondary vanes divide the interior of the housing into four chambers.

74. The fluid machine of claim 65, wherein the secondary vane is pivotally mounted to the rotary shaft by pivotally coupling the secondary vane to the primary vane.

75. The fluid machine of claim 65, wherein the fixed shaft is moved to the various fixed positions by rotating the fixed shaft about an axis coaxial with the primary axis.

76. The fluid machine of claim 65, wherein the exterior of the housing is contoured to provide increased surface area to facilitate cooling of the machine.

77. The fluid machine of claim 65, wherein the exterior of the housing is provided with a plurality of outwardly projecting ribs.

78. The fluid machine of claim 65, wherein the fluid machine is a motor.

79. The fluid machine of claim 65, wherein the fluid machine is a fluid pump.

80. The fluid machine of claim 65, wherein the fluid machine is a fluid compressor.

81. The fluid machine of claim 65, wherein the rate of fluid flow through the machine is adjusted by varying the position of the fixed shaft, while the rotary shaft is rotated at a generally constant rate.

82. The fluid machine of claim 65, wherein the point at which the secondary vane reaches the open and closed positions relative to the port by rotating the secondary vane shaft about the axis of the secondary vane shaft.

83. A race assembly of a spherical fluid machine for causing a reciprocating vane of the fluid machine to oscillate back and forth while rotating about a primary axis within a housing of the fluid machine, the race assembly comprising:

a carrier ring shaft that mounts within the housing of the fluid machine;

a carrier ring for coupling to the reciprocating vane, the carrier ring rotatably mounting to the carrier ring shaft so that the carrier ring rotates about a second axis that is at an oblique angle with respect to the primary axis;

a first shaft end portion that is joined to one end of the carrier ring shaft; and a second shaft end portion that mounts to the other end of the carrier ring shaft and is secured thereto by at least two removable fasteners that are eccentrically located with respect to the second axis.

84. A method of regulating fluid flow in a fluid machine comprising:

providing a housing of the machine that defines a housing interior, the housing having a port in communication with the interior of the housing through which fluid from a fluid source is allowed to flow;

providing at least one primary vane disposed within the interior of the housing that rotates about a primary axis;

providing at least one secondary vane disposed within the interior of the housing and mounted on a secondary vane shaft, wherein the axis of the secondary vane shaft is fixed relative to the primary axis;

rotating the primary vane about the primary axis with the secondary vane pivotally oscillating between alternating relatively open and closed positions with respect to the primary vane, the housing, the primary vane, and the secondary vane defining a fluid chamber for containing fluid within the housing interior having a volume that varies as the primary vane is rotated about the primary axis; and varying the point at which the secondary vane reaches the relatively open and closed positions relative to the port so that the degree of communication of the port with the fluid chamber defined by the primary and secondary vanes can be adjusted to vary the fluid flow through the port.

85. The method of claim 84, wherein the direction of fluid flow is reversed by varying the point at which the secondary vane reaches the open and closed positions relative to the port.

86. The method of claim 85, wherein the direction of rotation of the primary vane about the primary axis remains substantially constant.

87. The method of claim 84, wherein the rate of flow of the fluid through the device is changed by varying the point at which the secondary vane reaches the open and closed positions relative to the port.

88. The method of claim 87, wherein the rate of rotation of the primary vane about the primary axis is maintained substantially constant.

89. The method of claim 84, wherein the fluid is a compressible fluid.

90. The method of claim 84, wherein the fluid is a non-compressible fluid.

91. The method of claim 84, wherein the point at which the secondary vane reaches the open and closed positions relative to the port is varied by rotating the secondary vane shaft about the axis of the secondary vane shaft.

92. A method of regulating fluid flow in a fluid machine comprising:

providing a housing of the machine having a hollow interior and having at least two fluid ports in communication with the housing interior, at least one of the ports connected to a fluid source;

rotating a primary vane within the interior of the housing about a primary axis;

providing a secondary vane that is mounted on a secondary vane shaft and mounted within the housing for pivotal movement between relatively open and closed positions with respect to the primary vane, the secondary vane pivoting about a pivotal axis passing through the primary vane as the primary vane rotates, the primary and secondary vanes dividing the interior of the housing into chambers, with the volume of the chambers varying as the secondary vane oscillates between the relatively open and closed positions, the axis of the secondary vane shaft being fixed relative to the primary axis;

guiding the secondary vane to move between the relatively open and closed positions so that diametrically opposed points on the secondary vane rotate about a secondary vane rotational axis that intersects but which is angularly offset from the primary axis as the primary vane is rotated, the primary axis and secondary vane rotational axis defining a control plane; and adjusting the orientation of the control plane by adjusting the orientation of the secondary vane rotational axis in two or more positions so that communication of the ports with the chambers is adjusted to thereby regulate fluid flow through the machine.

93. The method of claim 92, wherein the direction of fluid flow is reversed by adjusting the orientation of the control plane.

94. The method of claim 93, wherein the direction of rotation of the primary vane about the primary axis remains constant.

95. The method of claim 92, wherein the rate of flow of the fluid through the device is changed by adjusting the orientation of the control plane.

96. The method of claim 95, wherein the rate of rotation of the primary vane about the primary axis is maintained substantially constant.

97. The method of claim 95, wherein the fluid is a compressible fluid.

98. The method of claim 92, wherein the fluid is a non-compressible fluid.

99. The method of claim 92 wherein adjusting the orientation of the control plane is performed by rotating the secondary vane shaft about the axis of the secondary vane shaft.

100. A method of regulating fluid flow in a fluid machine comprising:

providing a housing of the machine having a spherical hollow interior and having first and second fluid ports that are spaced apart from each other to provide fluid communication between the exterior of the housing and the interior, at least one of the first and second ports connected to a fluid source;

providing a primary vane disposed within the housing, the primary vane being rotatable about a primary axis;

providing a fixed shaft that extends into the housing interior, the fixed shaft having a spherical end portion disposed within the interior about which the primary vane rotates, the fixed shaft being adjustably mounted to the housing so that the fixed shaft can be oriented in various fixed positions;

providing a carrier ring rotatably mounted on the spherical end portion of the fixed shaft, the carrier ring rotating about a carrier ring axis that is oriented at an oblique angle with respect to the primary axis;

providing a secondary vane that is pivotally mounted to the primary vane so that the secondary vane is pivotal about an axis perpendicular to the primary axis to allow the secondary vane to pivot between open and closed positions with respect the primary vane as the primary and secondary vanes are rotated together about the primary axis, the primary and secondary vanes dividing the interior of the housing into chambers, the secondary vane being pivotally coupled to the carrier ring so that the secondary vane is pivotal about an axis perpendicular to the carrier ring axis;

rotating the primary and secondary vanes about the primary axis while the fixed shaft is in a first fixed position, the rotation of the secondary vane about the primary axis causing the carrier ring to rotate about the carrier ring axis and thus cause the secondary vane to reciprocate between the open and closed positions as the primary and secondary vane are rotated about the primary axis, the primary and secondary vanes defining an inlet chamber as the secondary vane is reciprocated to the open position so that fluid enters the inlet chamber through the first port while the first port is in communication with the inlet chamber, and wherein the primary and secondary vanes define a discharge chamber as the secondary vane is reciprocated to the closed position so that fluid exits the discharge chamber through the second port while the second port is in communication with the discharge chamber; and moving the fixed shaft to a second position so that the degree of communication of the first and second ports with the inlet and discharge chambers defined by the primary and secondary vanes as the primary and secondary vanes are rotated about the primary axis is changed to vary the fluid flow through the machine.

101. The method of claim 100, wherein the direction of fluid flow is reversed when the fixed shaft is moved to the second position, the first port communicating with the discharge chamber and the second port communicating with the inlet chamber when the fixed shaft is in the second position.

102. The method of claim 101, wherein the direction of rotation of the primary and secondary vanes about the primary axis remains substantially constant.

103. The method of claim 100, wherein the rate of flow of the fluid through the device is changed when the fixed shaft is moved to the second position.

104. The method of claim 103, wherein the rate of rotation of the primary and secondary vanes about the primary axis is maintained substantially constant.

105. The method of claim 100, wherein a lever is provided with the fixed shaft to facilitate rotating of the fixed shaft to the second fixed positions.

106. The method of claim 100, wherein a control member is provided with the fixed shaft, the control member mounting to the housing and engaging the fixed shaft so that the fixed shaft is maintained in the desired fixed position.

107. A method of regulating fluid flow in a fluid machine comprising:

providing a housing of the machine that defines a housing interior, the housing having a port in communication with the interior of the housing through which fluid from a fluid source is allowed to flow;

providing at least one primary vane disposed within the interior of the housing that rotates about a primary axis, wherein the primary axis is immovable relative to the housing;

providing at least one secondary vane disposed within the interior of the housing and mounted to the primary vane;

rotating the primary vane about the primary axis with the secondary vane pivotally oscillating between alternating relatively open and closed positions with respect to the primary vane, the housing, the primary vane, and the secondary vane defining a fluid chamber for containing fluid within the housing interior having a volume that varies as the primary vane is rotated about the primary axis; and varying the point at which the secondary vane reaches the relatively open and closed positions relative to the port so that the degree of communication of the port with the fluid chamber defined by the primary and secondary vanes can be adjusted to vary the fluid flow through the port.

108. The method of claim 107, wherein the direction of fluid flow is reversed by varying the point at which the secondary vane reaches the open and closed positions relative to the port.

109. The method of claim 108, wherein the direction of rotation of the primary vane about the primary axis remains substantially constant.

110. The method of claim 107, wherein the rate of flow of the fluid through the device is changed by varying the point at which the secondary vane reaches the open and closed positions relative to the port.

111. The method of claim 110, wherein the rate of rotation of the primary vane about the primary axis is maintained substantially constant.

112. The method of claim 107, wherein the fluid is a compressible fluid.

113. The method of claim 107, wherein the fluid is a non-compressible fluid.

114. The method of claim 107, wherein the point at which the secondary vane reaches the open and closed positions relative to the port by rotating the secondary vane shaft about the axis of the secondary vane shaft.

115. A method of regulating fluid flow in a fluid machine comprising:

providing a housing of the machine having a hollow interior and having at least two fluid ports in communication with the housing interior, at least one of the ports connected to a fluid source;

rotating a primary vane within the interior of the housing about a primary axis, wherein the primary axis is immovable relative to the housing;

providing a secondary vane that is mounted to the primary vane within the housing for pivotal movement between relatively open and closed positions with respect to the primary vane, the secondary vane pivoting about a pivotal axis passing through the primary vane as the primary vane rotates, the primary and secondary vanes dividing the interior of the housing into chambers, with the volume of the chambers varying as the secondary vane is moved between the relatively open and closed positions;

guiding the secondary vane to move between the relatively open and closed positions so that diametrically opposed points on the secondary vane rotate about a secondary vane rotational axis that intersects but which is angularly offset from the primary axis as the primary vane is rotated, the primary axis and secondary vane rotational axis defining a control plane; and adjusting the orientation of the control plane by adjusting the orientation of the secondary vane rotational axis in two or more positions so that communication of the ports with the chambers is adjusted to thereby regulate fluid flow through the machine.

116. The method of claim 115, wherein the direction of fluid flow is reversed by adjusting the orientation of the control plane.

117. The method of claim 116, wherein the direction of rotation of the primary vane about the primary axis remains constant.

118. The method of claim 115, wherein the rate of flow of the fluid through the device is changed by adjusting the orientation of the control plane.

119. The method of claim 118, wherein the rate of rotation of the primary vane about the primary axis is maintained substantially constant.

120. The method of claim 118, wherein the fluid is a compressible fluid.

121. The method of claim 115, wherein the fluid is a non-compressible fluid.

122. The method of claim 115 wherein adjusting the orientation of the control plane is performed by rotating the secondary vane shaft about the axis of the secondary vane shaft.

* * * * *

UNITED STATES PATENT AND TRADEMARK OFFICE

CERTIFICATE OF CORRECTION

PATENT NO. : 6,241,493 B1
DATED : June 5, 2001
INVENTOR(S) : Turner

It is certified that error appears in the above-identified patent and that said Letters Patent is hereby corrected as shown below:

Column 5,
Lines 49-50, delete "62; and 64" and insert -- 62, 64 --

Column 6,
Line 25, delete "82; and" and insert -- 82, --

Column 8,
Line 18, delete "in"

Column 9,
Line 38, delete "and"

Column 11,
Line 6, after "secondary", insert -- vane --

Column 14,
Line 32, delete the comma after "22"
Line 33, after "272", delete ", respectively"
Line 34, delete "277" and insert -- 271 --
Line 34, delete the comma after "58" and insert -- and --
Line 35, delete "76 and 78" and insert -- 76, 78 --
Line 51, delete "FIG. 22" and insert -- FIG. 23 --

Column 15,
Line 45, delete "adjusted" and insert -- adjusting --

UNITED STATES PATENT AND TRADEMARK OFFICE

CERTIFICATE OF CORRECTION

PATENT NO. : 6,241,493 B1
DATED : June 5, 2001
INVENTOR(S) : Turner

It is certified that error appears in the above-identified patent and that said Letters Patent is hereby corrected as shown below:

Column 26,
Line 9, after "respect", insert -- to --

Signed and Sealed this

Seventh Day of June, 2005

JON W. DUDAS
*Director of the United States Patent and Trademark Office*